US010617581B2

(12) United States Patent
Gibson et al.

(10) Patent No.: US 10,617,581 B2
(45) Date of Patent: Apr. 14, 2020

(54) OCCUPANT SUPPORT WITH LONGITUDINALLY SPACED TURN ASSIST MEMBERS, ASSOCIATED GRAPHICAL USER INTERFACE, AND METHODS OF PROVIDING ACCESS TO PORTIONS OF THE OCCUPANT SUPPORT OR TO OCCUPANTS THEREOF

(71) Applicant: Hill-Rom Services, Inc., Batesville, IN (US)

(72) Inventors: Luke Gibson, Greensburg, IN (US); Andrew R. Kerr, Cincinnati, OH (US); Charles A. Lachenbruch, Batesville, IN (US); Eric R. Meyer, Batesville, IN (US); Joshua A. Williams, Harrison, OH (US); Rachel L. Williamson, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 1187 days.

(21) Appl. No.: 14/631,140

(22) Filed: Feb. 25, 2015

(65) Prior Publication Data

US 2015/0164720 A1 Jun. 18, 2015

Related U.S. Application Data

(63) Continuation-in-part of application No. PCT/US2013/056181, filed on Aug. 22, 2013.
(Continued)

(51) Int. Cl.
*A61G 7/00* (2006.01)
*A61G 7/057* (2006.01)

(52) U.S. Cl.
CPC ..... *A61G 7/001* (2013.01); *A61G 7/05769* (2013.01); *A61G 7/05776* (2013.01)

(58) Field of Classification Search
CPC ..... A61G 7/00; A61G 7/001; A61G 7/05723; A61G 7/05769; A61G 7/05776;
(Continued)

(56) References Cited

U.S. PATENT DOCUMENTS 5,794,289 A * 8/1998 Wortman ..... A61G 7/001 5/423
5,983,429 A 11/1999 Stacy et al.
(Continued)

FOREIGN PATENT DOCUMENTS

EP 2494946 A2 9/2012
JP 06-80425 U 11/1994
(Continued)

OTHER PUBLICATIONS

International Search Report for International Application PCT/US2013/05618; International Filing Date—Aug. 22, 2013; Earliest Priority Date—Aug. 29, 2012.
(Continued)

*Primary Examiner* — Robert G Santos
*Assistant Examiner* — David R Hare
(74) *Attorney, Agent, or Firm* — Kenneth C. Baran

(57) ABSTRACT

An occupant support includes a turn assist layer which includes left and right side arrays of two or more longitudinally distributed turn assist members. Each array member comprises one or more longitudinally distributed turn assist bladders. At least two of the array members on the left side are longitudinally spaced from each other by a left intermember reach-in space having a left intermember dimension. At least two of the array members on the right side are longitudinally spaced from each other by a right intermember reach-in space having a right intermember dimension. A support layer resides above the turn assist layer. The support layer includes a collapsible zone at least part of which
(Continued)

overlies the intermember spaces. The occupant support also includes a user interface for enabling a user to operate the turn assist layer.

16 Claims, 42 Drawing Sheets

Related U.S. Application Data

(60) Provisional application No. 61/694,540, filed on Aug. 29, 2012, provisional application No. 61/694,553, filed on Aug. 29, 2012, provisional application No. 61/734,643, filed on Dec. 7, 2012, provisional application No. 61/734,673, filed on Dec. 7, 2012.

(58) Field of Classification Search
CPC ..... A47C 27/00; A47C 27/08; A47C 27/081; A47C 27/10; A47C 27/142
See application file for complete search history.

(56) References Cited

U.S. PATENT DOCUMENTS

| | | | | |
|---|---|---|---|---|
| 6,584,628 | B1 * | 7/2003 | Kummer | A61G 7/00 5/615 |
| 7,007,330 | B2 * | 3/2006 | Kuiper | A61G 7/001 5/615 |
| 7,681,269 | B2 * | 3/2010 | Biggie | A61G 7/001 5/709 |
| 7,712,171 | B2 * | 5/2010 | Butler | A61G 7/001 5/715 |
| 2003/0159219 | A1 * | 8/2003 | Harrison | A61G 7/001 5/713 |
| 2006/0101581 | A1 | 5/2006 | Blanchard et al. | |
| 2008/0040860 | A1 * | 2/2008 | Price | A61G 7/05776 5/710 |
| 2008/0235875 | A1 | 10/2008 | Wells | |
| 2010/0071137 | A1 * | 3/2010 | Doehler | A61G 7/05715 5/713 |
| 2011/0163885 | A1 * | 7/2011 | Poulos | A61G 7/05776 340/626 |
| 2012/0198627 | A1 * | 8/2012 | Turner | A61G 7/015 5/610 |
| 2012/0222214 | A1 * | 9/2012 | Lachenbruch | A61G 7/001 5/81.1 R |
| 2012/0311790 | A1 * | 12/2012 | Nomura | A61G 7/05776 5/710 |
| 2014/0007353 | A1 * | 1/2014 | Stryker | A61G 7/001 5/715 |

FOREIGN PATENT DOCUMENTS

| | | | |
|---|---|---|---|
| JP | 11299839 | A | 11/1999 |
| JP | 2000189470 | A | 7/2000 |
| JP | 2006051212 | A | 2/2006 |
| WO | 2011006093 | A1 | 1/2011 |

OTHER PUBLICATIONS

Written Opinion of the International Searching Authority for International Application PCT/US2013/056181; International Filing Date—Aug. 22, 2013; Earliest Priority Date—Aug. 29, 2012.
Communication pursuant to Article 94(3) EPC; EP Application No. 11756789.7; dated May 25, 2016.
Response to Written Opinion of the International Searching Authority for International Application PCT/US2013/056181; International Filing Date—Aug. 22, 2013; Earliest Priority Date—Aug. 29, 2012; EP Application No. 13756789.7.
Amended Pages—EP Application No. 13756789.7.
Amended Pages Tracked—EP Application No. 13756789.7.
Claims—EP Application No. 13756789.7.
Claims Tracked—EP Application No. 13756789.7.
Letter to EPO dated Oct. 13, 2016 responding to Communication pursuant to Article 94(3) EPC; EP Application No. 13756789.7; dated May 25, 2016.
Claims (Final) EP Application No. 13756789.7.
Office Action for JP Application No. 2015-529872; Mailing No. 317875; dated Jul. 25, 2017.
Search Report for EP Application 17192844.3 dated Dec. 21, 2017; Place of search—The Hague; Date of completion of the search—Dec. 14, 2017.
Claim Amendments filed Jun. 5, 2019 for JP Application No. 2017-234045.
Response dated Aug. 1, 2018 to Search Report for EP Application 17192844.3.
JP Office Action for Application 2017-234045 ; Mailing No. 531035; dated Dec. 11, 2018.
Communication pursuant to Article 94(3) EPC for EP Application 17192844.3; dated May 22, 2019.
Response to Communication Pursuant to Article 94(3) for EP Application 17192844.3 dated Nov. 28, 2019.
Amended Pages Filed (Final) for EP Application 17192844.3.
Amended Pages Filed (Tracked) for EP Application 17192844.3.
Claims Filed (Final) for EP Application 17192844.3.
Claims Filed (Tracked) for EP Application 17192844.3.
JP Office Action dated Nov. 12, 2019—JP Application 2017-234045.

* cited by examiner

OCCUPANT SUPPORT WITH LONGITUDINALLY SPACED TURN ASSIST MEMBERS, ASSOCIATED GRAPHICAL USER INTERFACE, AND METHODS OF PROVIDING ACCESS TO PORTIONS OF THE OCCUPANT SUPPORT OR TO OCCUPANTS THEREOF

TECHNICAL FIELD

The subject matter described herein relates to occupant supports such as mattresses and particularly to an occupant support which includes longitudinally spaced apart turn assist members. This application also describes a method of providing access to a portion of a mattress occupant or to a portion of the mattress itself, which portions are otherwise not readily accessible by reason of being in mutual contact. This application also shows one or more embodiments of a graphical user interface/touch screen interface.

The subject matter described herein also relates to occupant supports such as mattresses and particularly to an occupant support which includes longitudinally distributed turn assist members which are independently operable. This application also describes a method of providing access to a portion of a mattress occupant or to a portion of the mattress itself, which portions are otherwise not readily accessible by reason of being in mutual contact. This application also shows one or more embodiments of a graphical user interface/touch screen interface.

BACKGROUND

In a hospital or other health care setting patients may be confined to a bed for an extended period of time. In the case of a supine patient, his or her posterior side is in mutual contact with the upper surface of a mattress. As a result the patient's posterior side and the portion of the mattress surface underneath the patient are not readily accessible to caregivers. However access to the patient's posterior side may be necessary so that caregivers can monitor the patient's skin health, particularly for evidence of incipient pressure ulcers and/or apply treatment or therapy which may or may not be related to skin disorders. A posterior portion of the patient that is of particular concern is a "target" region extending approximately from the patient's gluteal sulcus to approximately the base of the sacrum or the sacral promontory because this portion of the patient's body is highly susceptible to pressure ulcers. In addition, a caregiver may require similar access to clean the patient and the mattress following an incontinence event. Accordingly, the phrase "target region", as used herein refers not only to a portion of the patient but also to a substantially longitudinally coextensive portion of the mattress.

Under existing practices caregivers achieve target region access by manually rotating the patient onto his or her side and, if necessary, holding the patient in the rotated position with one hand while concurrently carrying out the necessary care activity with the other hand. This practice has the disadvantage of putting the caregiver at risk of injury, especially back injury, when rotating the patient, preventing the caregiver from using both hands to carry out the care activity, or requiring two caregivers where one would be sufficient for the care activity itself. Alternatively, the caregiver may use pillows or cushions to support the patient in the rotated position. However this alternative practice does not change the risk of caregiver injury when rotating the patient, and has the added disadvantage that the pillows or cushions may not be readily available and may have to be laundered after the care activity is concluded.

SUMMARY

One variant of an occupant support described herein comprises a turn assist layer which includes a left side array of two or more longitudinally distributed turn assist members. Each member of the array comprises one or more longitudinally distributed turn assist bladders. At least two of the array members are longitudinally spaced from each other by a left intermember reach-in space having a left intermember dimension. The occupant support also comprises a right side array of two or more longitudinally distributed turn assist members. Each member of the right side array comprises one or more longitudinally distributed turn assist bladders. At least two of the right side array members are longitudinally spaced from each other by a right intermember reach-in space having a right intermember dimension. A related method of providing access to a target region comprises inflating at least one turn assist zone so that the inflated zone exhibits a lateral variation in height which increases with increasing lateral distance from the centerline of the occupant support and maintaining inflation of the inflated turn assist zone for a user determined period of time.

Another variant of an occupant support described herein comprises a support layer and a turn assist layer below the support layer. The turn assist layer includes a left side array of two or more longitudinally distributed turn assist members and a right side array of two or more longitudinally distributed turn assist members. The occupant support also includes a controller configured to inflate at least one turn assist member of a selected one of the left and right arrays and to subsequently deflate a subset of the more than one turn assist member, in response to at least one user command. A related method of providing access to a target region of an occupant of a mattress and/or of the mattress itself comprises inflating at least one turn assist member of a selected one of the left and right arrays and subsequently deflating a subset of the at least one turn assist member.

Another variant related to occupant supports is a mattress comprising a turn layer comprised of left and right turn effectors, and a support layer atop the turn effectors. Left and right bolsters border the left and right sides of the support layer. In another variant the mattress includes a center tie adapted to apply a counterforce to the support layer laterally between the left and right turn effectors. An associated method of relieving loading on an occupant of a bed comprises turning the occupant laterally in a first turn direction and maintaining the occupant in an orientation resulting from the turning in the first turn direction for a predefined first interval of time while supporting the occupant in a first support direction consistent with reducing frictional force that would otherwise act on the occupant.

BRIEF DESCRIPTION OF THE DRAWINGS

The foregoing and other features of the various embodiments of the occupant support and method described herein will become more apparent from the following detailed description and the accompanying drawings in which.

DETAILED DESCRIPTION

Description of the First Variant

Figure 1:
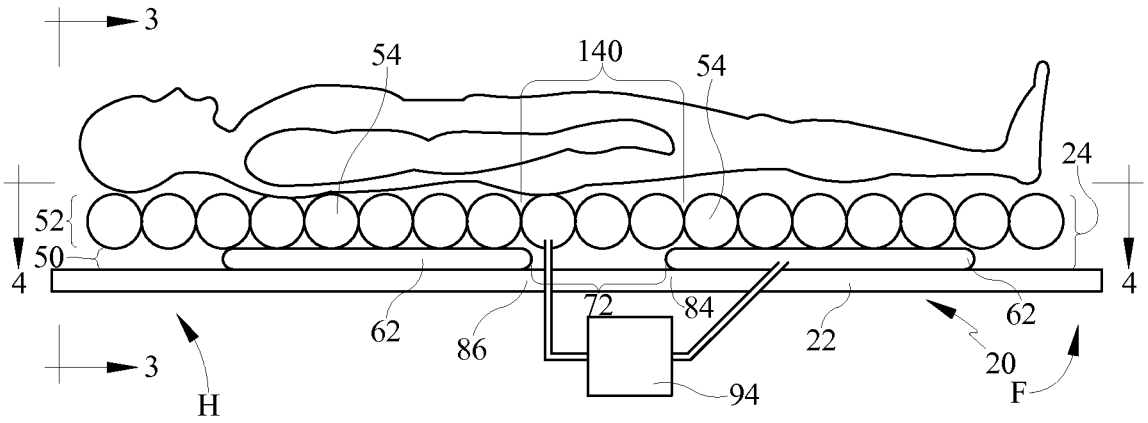
FIG. 1 is a schematic side elevation view showing a hospital bed deck and mattress in which the mattress comprises a turn assist layer shown in a deflated or depressurized state, and a support layer and also showing a supine occupant lying on the mattress.
Figure 2:
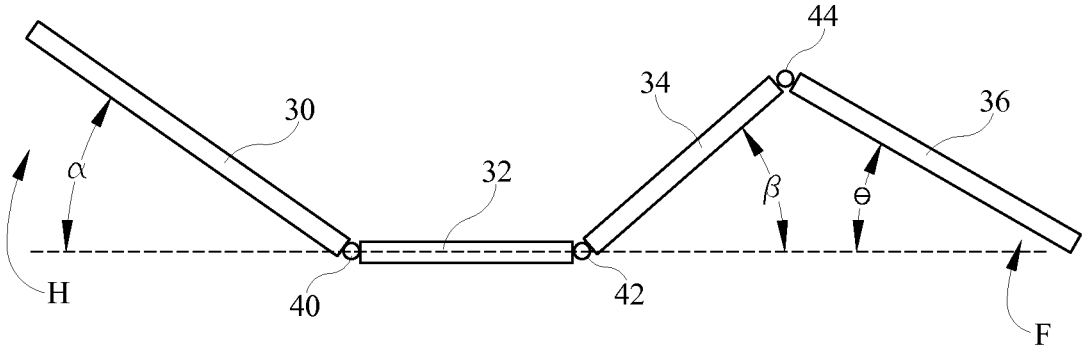
FIG. 2 is a side elevation view of a segmented deck for a hospital bed.

Referring to FIGS. 1-4 a hospital bed 20 includes a frame, not shown, a deck 22 supported on the frame, and an occupant support or mattress 24. As seen in FIG. 2 deck 22 may be constructed of multiple segments such as an upper body or torso segment 30 corresponding to an occupant's torso, a seat segment 32 corresponding to an occupant's buttocks, a thigh segment 34 corresponding approximately to an occupant's thighs, and a calf/foot segment 36 corresponding to an occupant's calves and feet. The torso, thigh and calf sections are orientation adjustable about hinges 40, 42, 44 as indicated by angles $\alpha$, $\beta$, $\theta$ in FIG. 2. The bed extends longitudinally from a head end H to a foot end F and laterally from a left side L to a right side R. A notional centerplane 46, which contains a longitudinally extending centerline 48, shown at an arbitrary height, distinguishes left and right lateral sides of the bed and occupant support. The occupant support includes a turn assist layer 50 and, if the turn assist layer is not satisfactory for occupant support and comfort (as is usually the case), includes a support layer 52 above the turn assist layer. The illustrated support layer is a set of longitudinally distributed inflatable and deflatable air bladders 54 but may be a foam layer or other alternative construction.

Figure 3:
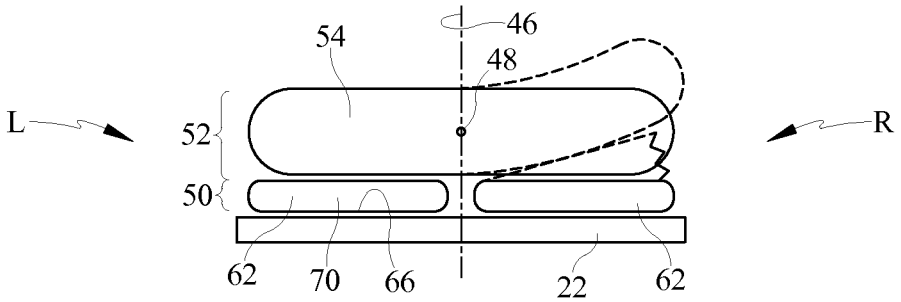
FIG. 3 is a view in direction 3-3 of FIG. 1 excluding the occupant and showing a right hand member of the turn assist layer in both a deflated state (solid lines) and an inflated state (dashed lines).
Figure 4:
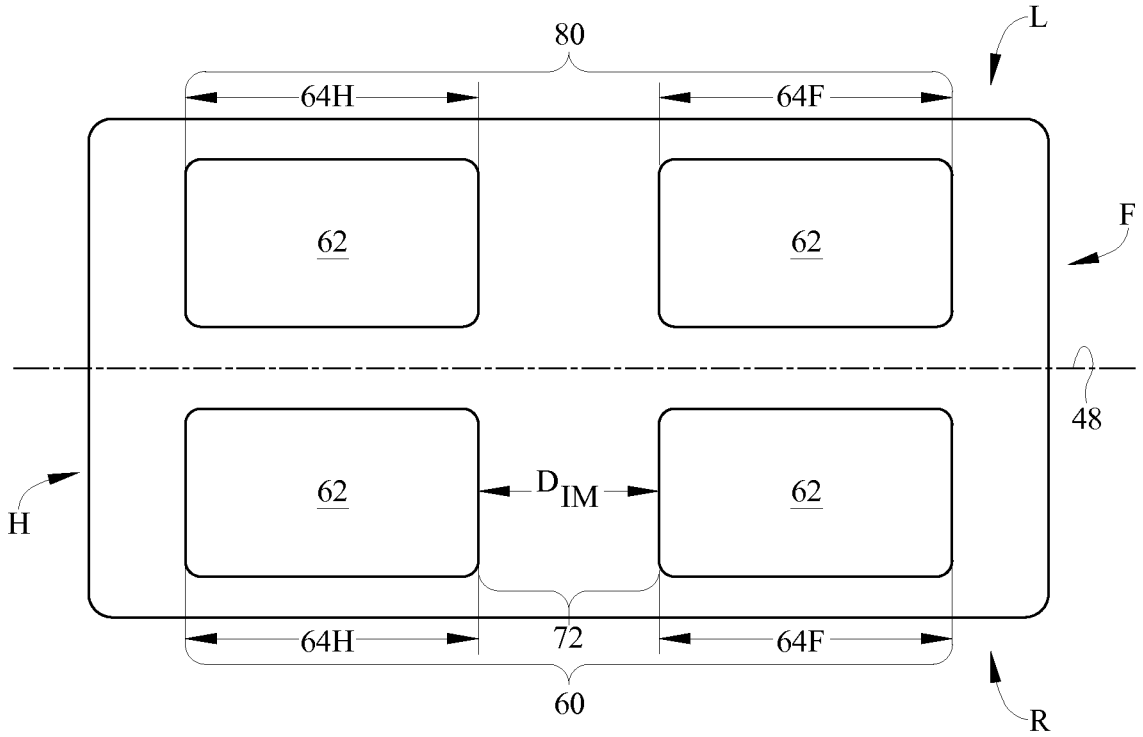
FIG. 4 is a schematic plan view of the turn assist layer in direction 4-4 of FIG. 1.
Figure 5:
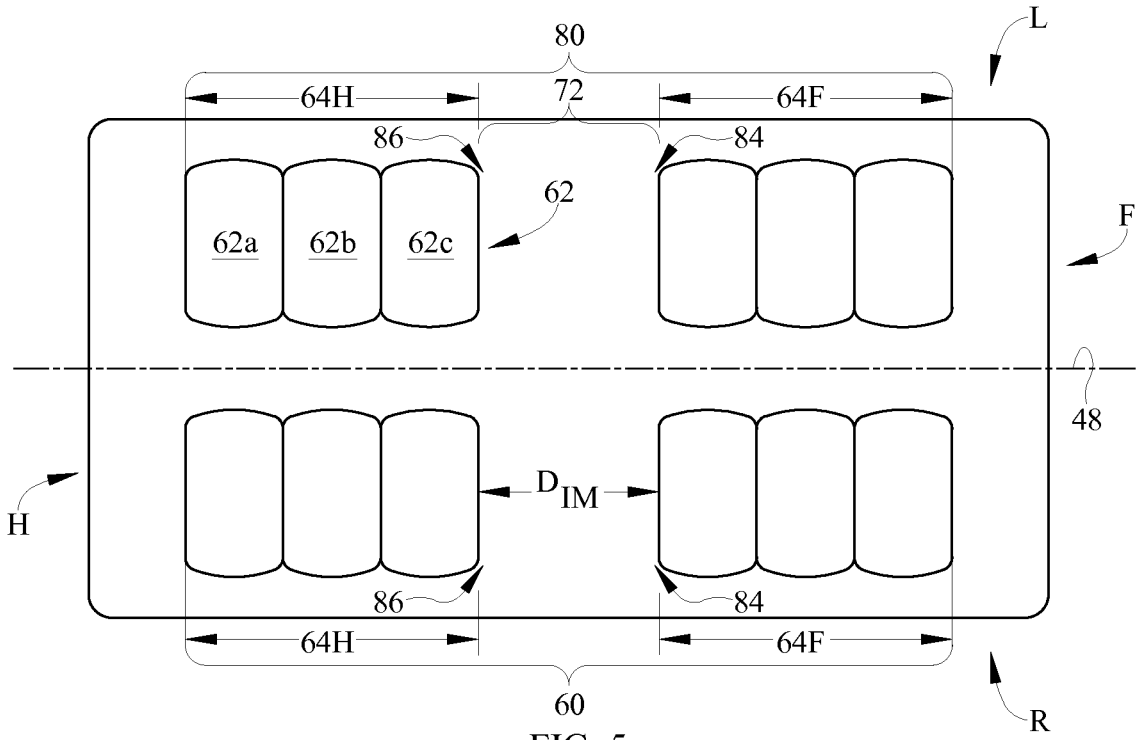
FIG. 5 is a schematic plan view similar to that of FIG. 4 showing an alternative turn assist layer architecture.

Turn assist layer 50 includes a right side array 60 of two longitudinally distributed turn assist members 62 each of which corresponds to a turn assist zone 64H, 64F. Each turn assist member 62 is a single inflatable and deflatable bladder as seen in FIG. 4 but may instead be an assembly of multiple bladders as seen in FIG. 5. Each bladder 62 comprises a casing 66 (FIG. 3) which bounds a volume of space 70. The contents of space 70 consists essentially of a bladder pressurizing medium such as air, some amount of which is present even when the bladder is in its deflated state (FIG. 1 and FIG. 3, solid lines). Alternatively the deflated state may be achieved by evacuating space 70 of air until a vacuum is achieved. Either way, volume 70 is substantially devoid of load bearing features, other than pressurized air, for supporting the weight of an occupant. The two members of the array are longitudinally spaced from each other by a right intermember space 72 having a right intermember dimension $D_{IM}$. Consistent with the intent of the innovation described herein, space 72 will also be referred to as a reach-in space.

Turn assist layer 50 also includes a left side array 80 of two or more longitudinally distributed turn assist members. Left side array 80 and right side array 60 are substantially mirror images of each other. Components and features on the left and right sides (e.g. turn assist bladders, reach-in space) are longitudinally aligned with each other. Accordingly, common reference numerals and symbols are used herein to refer to analogous components of the left and right arrays except when it is necessary to distinguish between left and right components or features, in which case a reference character L or R is appended to the reference numeral in question. Similarly, a reference character H or F is applied to reference numeral 62 when it is necessary to distinguish between the turn assist bladder closer to the head end of the bed and the turn assist bladder closer to the foot end of the bed on a given side of centerplane 46.

Reach-in space 72 extends longitudinally from a more footward location 84 corresponding substantially to the gluteal sulcus of an occupant nominally positioned on the mattress to a more headward location 86 corresponding approximately to the sacral base or sacral promontory of a nominally positioned occupant. A nominally positioned occupant is one who is approximately laterally centered on the bed, i.e. one whose saggital plane approximately coincides with centerplane 46 when the occupant is supine on the mattress, and who is positioned longitudinally so that the positions of his or her anatomical features are compatible with the physical and/or functional features of the bed. For example, many beds include a hip indicator to indicate the approximate, desired longitudinal position of the occupant's hips. In another example the hinges 40, 42, 44 (FIG. 2) of beds having segmented decks are clear indicators of the approximate desired longitudinal position of the occupant's anatomical features (e.g. buttocks positioned between hinges 40, 42; popliteal region positioned over hinge 44).

Although the gluteal sulcus and sacral base are thought to be satisfactory longitudinal boundaries for reach-in space 72, boundaries corresponding to a longitudinally wider space 72 may also be satisfactory. For example footward location 84 might correspond to a point about one third of the way from the gluteal sulcus to the knee. Headward location 86 might correspond to a point in the vicinity of the T12/L1 intervertebral disc. A reach in space that encompasses the occupant's sacral region may be useful for relieving loading on the sacral region. Boundaries corresponding to a longitudinally narrower space 72 may also be satisfactory provided that the desired meaningful access to a target region of the occupant's posterior is not impeded. Meaningful access refers to the ability to access the region and carry out a care operation such as inspecting for or treating pressure ulcers or cleaning the occupant or portion of the mattress after an incontinence event. An intermember dimension $D_{IM}$ of at least about 20 centimeters (8 inches) is thought to be adequate.

Figure 6:
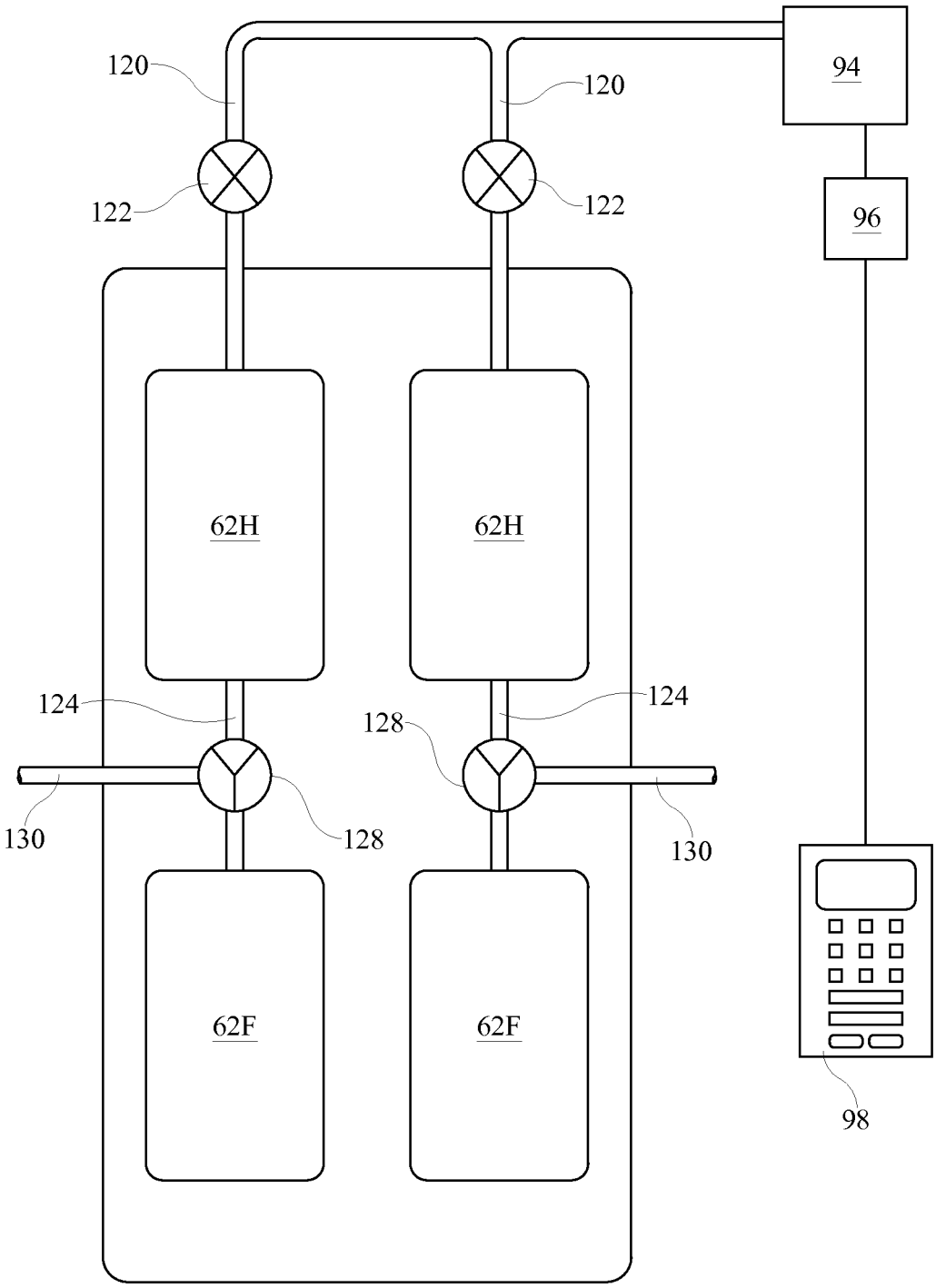
FIG. 6 is a schematic plan view similar to that of FIG. 4 showing one possible arrangement of conduits and valves for inflating and deflating bladders of the turn assist layer.

Referring additionally to FIG. 6, the bed also includes a blower and/or compressor 94, various conduits 120, 130 and valves 122, 128 for regulating fluid flow through the conduits. The occupant support also includes a controller 96 and a user interface device 98 by means of which a user can issue commands to the controller. The controller operates the valves and compressor in response to user commands entered by way of user interface device 98.

Figure 7:
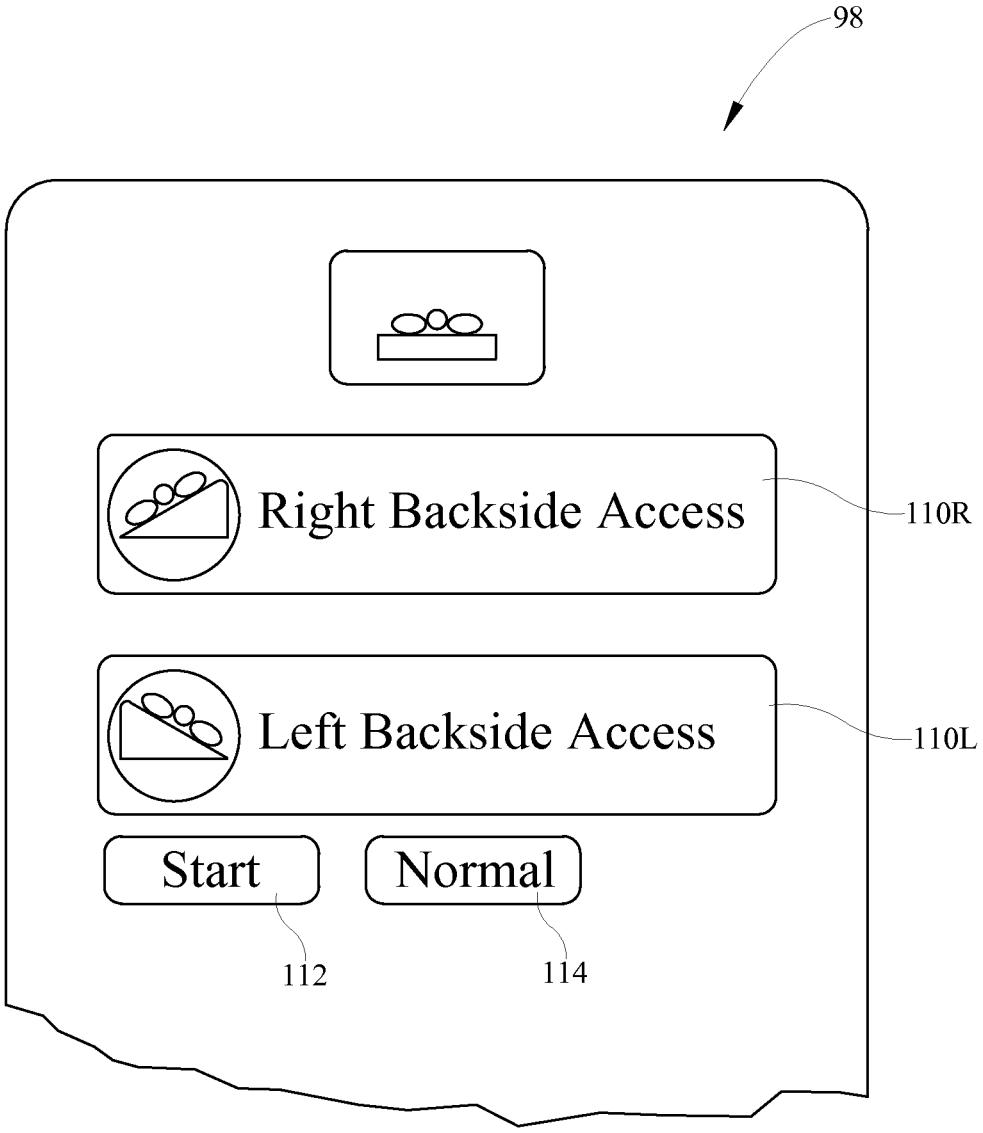
FIG. 7 is a view showing example elements of a user interface display.

FIG. 7 shows the appearance of an example user interface display. The display includes left and right select buttons 110L, 110R enabling a user to select left side operation, which will rotate the occupant to his or her right to provide access to the target region from the left side of the bed, or right side operation which will rotate the occupant to his or her left to provide access to the target region from the right side of the bed. The display also includes a start button 112 and a cancel or return or normal button 114.

Figure 8:
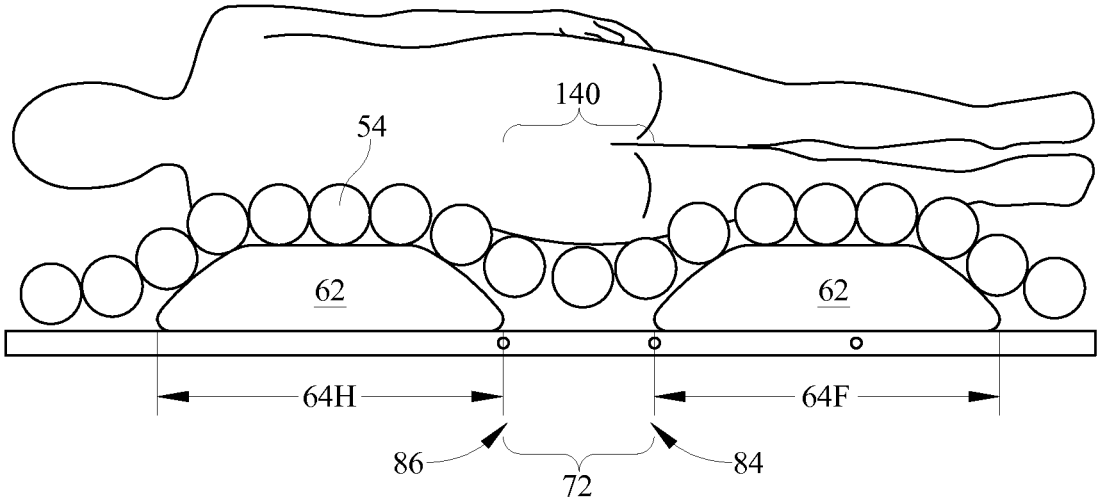
FIG. 8 is a view similar to that of FIG. 1 showing the turn assist bladders having been inflated to provide access to a target region of the occupant and/or mattress.
Figure 9:
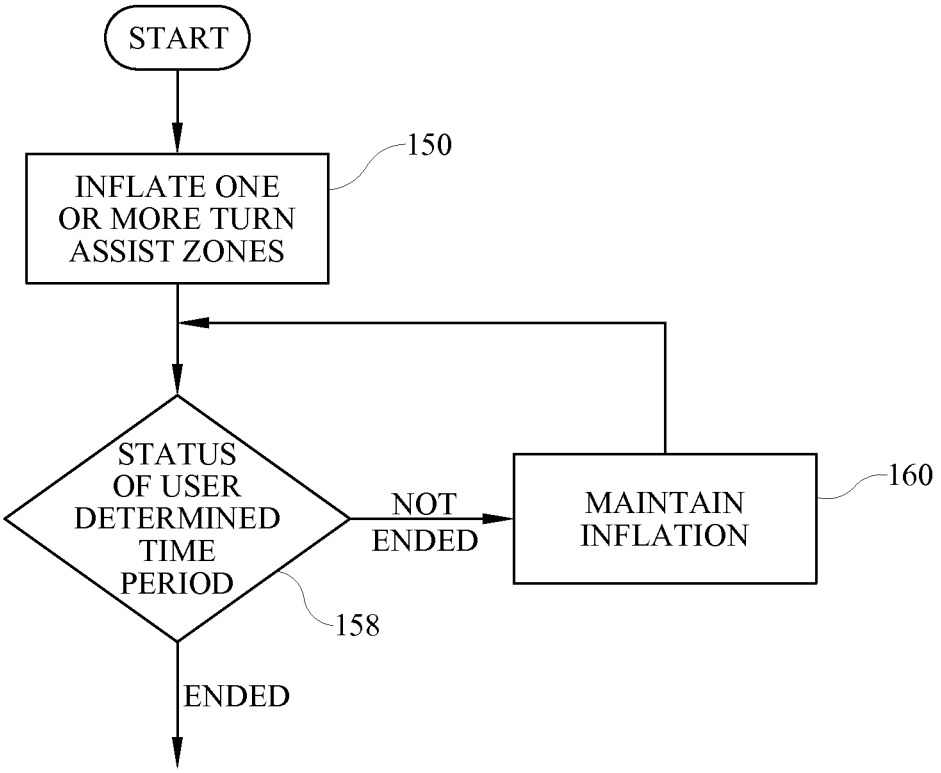
FIG. 9 is a block diagram showing a method of providing access to the target region.

Referring principally to FIGS. 1, 6-8 and the block diagram of FIG. 9, controller 96 is adapted to pressurize and therefore inflate the turn assist bladders 62 (i.e. cause inflation of the turn assist zones 64) of a selected one of the arrays (left or right) of turn assist members in response to a first user command, and to maintain inflation of those bladders until receipt of a second user command. For example, a user selects left or right side operation by pressing the appropriate left or right select button 110L or 110R and issues the first command by pressing start button 112. In response, controller 96 operates the compressor and the appropriate valves, as discussed in more detail below, to concurrently pressurize and therefore inflate the turn assist bladders on the selected side (left or right) of the occupant support (block diagram block 150). Once inflated, the bladder or zone exhibits a lateral variation in height which increases with increasing lateral distance from the centerline as seen in FIG. 3 (dashed lines). As seen in FIG. 8 this creates an interbladder cavity corresponding to space 72. Because of the height variation exhibited by the inflated turn assist bladders (seen in FIG. 3) the interbladder cavity is shallow near centerplane 46 and increases in depth with increasing lateral distance away from centerplane 46. The controller maintains inflation of the inflated turn assist zones for a user determined period of time (FIG. 9, blocks 158-160). While inflation is maintained the occupant is supported on his side by the inflated turn assist bladders as seen in FIG. 8. The support bladders can sag into the interbladder cavity corresponding to reach-in space 72. A caregiver can access the target region to attend to required tasks involving the occupant or the mattress by reaching into reach-in space 72. In addition the caregiver can press the support bladders into the cavity to improve access to the target region. The user determined period of time elapses (block 158) when the caregiver, having determined that the inflated turn assist bladders should be deflated (typically as a result of having completed the care task), issues the second command by pressing the cancel or return button 114. In response, the controller operates the valves and/or compressor to concurrently deflate the inflated turn assist bladders thus returning the occupant support to its baseline state, i.e. to the state seen in FIG. 1. In FIG. 8 the occupant has been rotated onto his left side so that the caregiver can access the target region from the right side of the bed. Depending on the nature of the care activity, the caregiver may also need to move to the other (left) side of the bed and rotate the occupant onto his right side to complete the care activity.

In principle the controller could be configured to respond to the first command by inflating only one of the two bladders of the selected bladder array, however such operation is thought to be less desirable than inflating both (or all) bladders of the selected bladder array because of its potential to twist the occupant.

One variant of the occupant support is to dispense with start button 112 and initiate pressurization and inflation of the selected turn assist bladders (left or right) in response to the user's selection of left or right side inflation. In other words user pressure applied to the left or right select button 110L, 110R not only selects the left or right side but also causes pressurization of the turn assist bladders on that side. The first user command is therefore a combination of the select command and the bladder inflation command. Other user interface arrangements may also be satisfactory.

The above description is directed to an occupant support having two turn assist bladders on each side of the bed. However the concept applies to occupant supports having three or more bladders per side and in which at least two of those bladders are longitudinally spaced from each other by an interbladder reach-in space. As with the two bladder configuration it is thought to be desirable to concurrently inflate and deflate all the bladders on a given side in order to avoid twisting the occupant or subjecting the occupant to other adverse effects that might arise from inflating fewer than all the bladders.

Returning to FIG. 6, one possible arrangement of components includes conduit 120 for establishing fluid communication between bladder 62H and compressor 94, and fill valves 122 for regulating fluid flow through the conduit. Intermember conduits 124, each with an intermember valve 128, extend between bladder 62H and bladder 62F. An exhaust conduit 130 extends from intermember valve 128 to atmosphere. In practice either the left bladder array or the right bladder array is selected. Thus the following operational description applies to either the left array or the right array but not to both arrays at the same time. A fill valve 122 is opened and corresponding intermember valve 128 is positioned to allow fluid communication between bladders 62H, and 62F but to block fluid flow through exhaust conduit 130 in order to enable the compressor to pressurize bladders 62H, 62F. When the bladders are satisfactorily pressurized, fill valve 122 may be closed and operation of the compressor curtailed. The pressurization of the turn assist bladders is maintained until a user presses button 114 (FIG. 7) indicating a desire to deflate bladders 62H, 62F. In response, the controller commands intermember valve 128 to a position that opens a path between bladders 62 and atmosphere thus venting and deflating bladders 62. A different valve and conduit arrangement would be required for the previously mentioned, less preferred mode of operation in which fewer than all the bladders are inflated.

As already noted the occupant support includes support layer 52 above turn assist layer 50. The support layer includes an inflatable and deflatable zone, also referred to as a collapsible zone 140, at least part of which overlies intermember reach-in space 72, and therefore is longitudinally coextensive with the reach-in space.

Referring principally to FIGS. 1, 6-7 and 10-11, the inflatable and deflatable nature of support layer 52 may be used in conjunction with the turn assist bladders to provide even better access to the target region. For example, a user selects left or right side operation by pressing the appropriate left or right select button 110L or 110R and issues the first command by pressing start button 112. In response, controller 96 operates the compressor and the appropriate valves, to concurrently pressurize and therefore inflate the turn assist bladders on the selected side (left or right) of the occupant support (block diagram block 150). The controller also deflates the support layer in at least the longitudinally extending portion of the support layer which overlies the reach-in space, i.e in zone 140, as shown at block diagram block 152. Inflation of the turn assist bladders and deflation of zone 140 may occur concurrently, partially concurrently, or serially.

Figure 10:
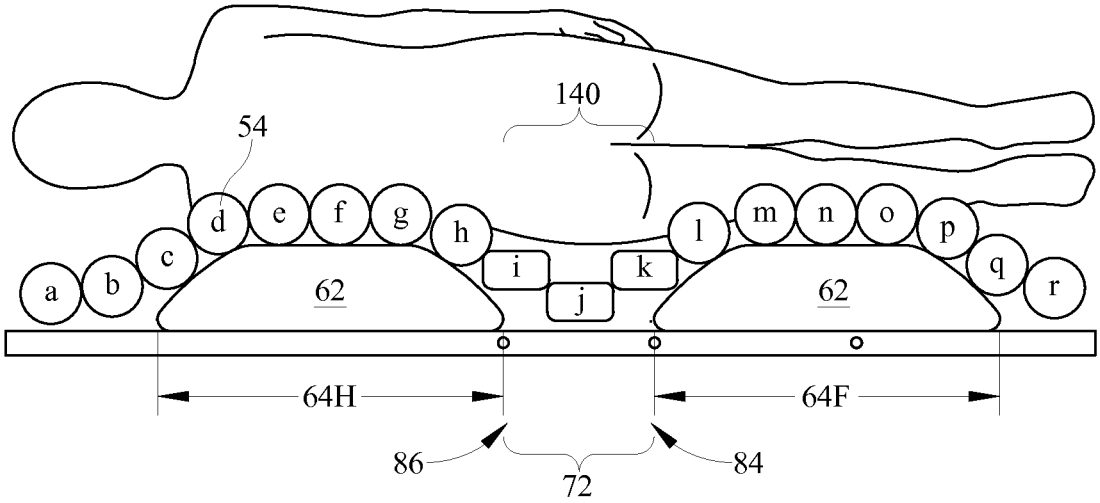
FIG. 10 is a view similar to that of FIG. 8 showing selected support bladders having been deflated to provide better access to the target region.
Figure 11:
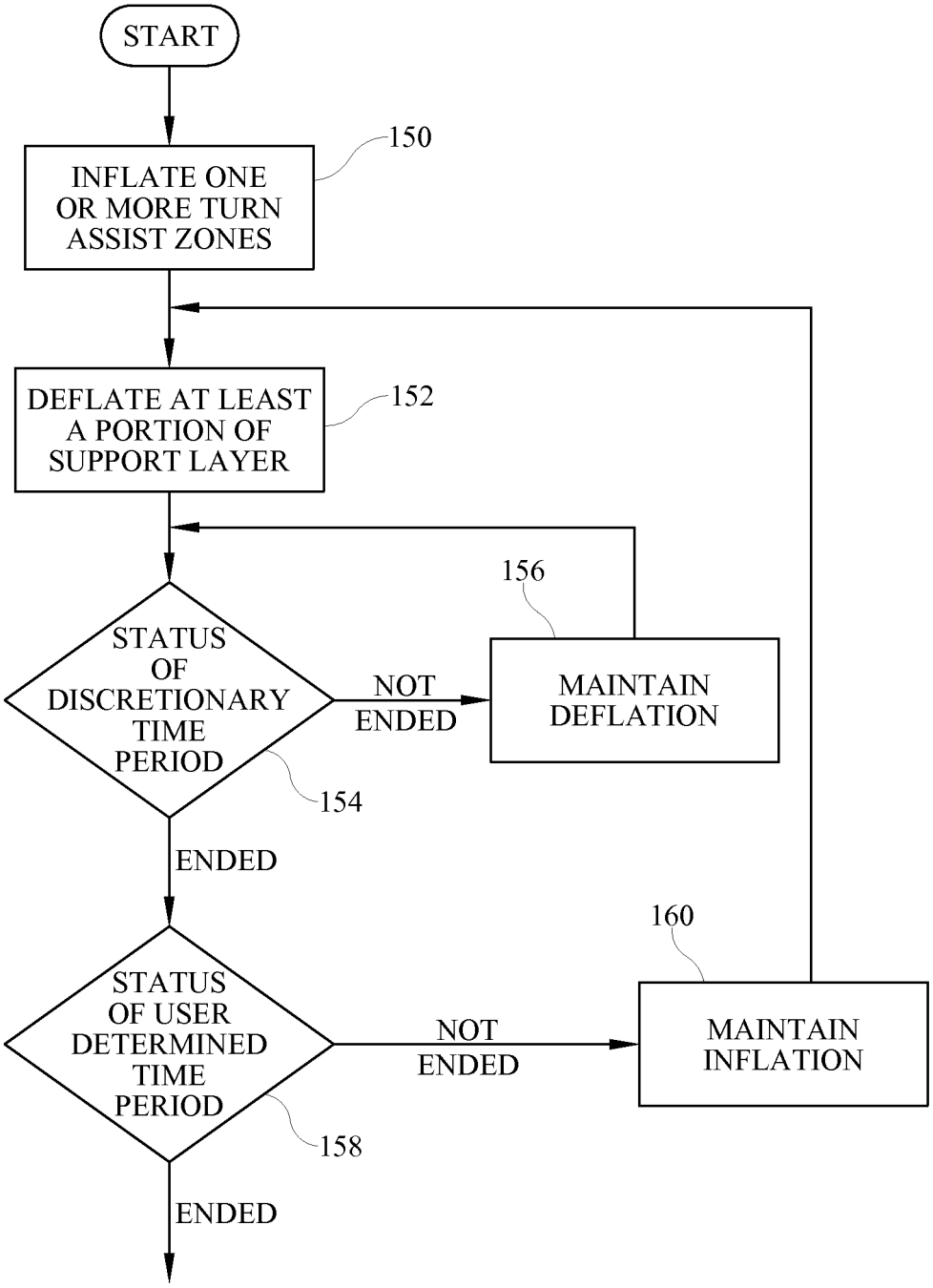
FIG. 11 is a block diagram showing a second method of providing access to the target region.

Alternatively, separate control buttons could be provided to offer the caregiver a degree of control over the sequence. The controller maintains inflation of the selected turn assist bladders for a user determined period of time (blocks 158, 160) and maintains deflation of the support layer portion for a discretionary period of time (blocks 154, 156). While inflation and deflation are maintained the occupant is supported on his side by the inflated turn assist bladders as seen in FIG. 10. The deflated support bladders can sag into the interbladder cavity corresponding to reach-in space 72. A caregiver can access the target region to attend to required tasks involving the occupant or the mattress by reaching into reach-in space 72. In addition the caregiver can, if necessary, press the support bladders further into the cavity to improve access to the target region.

The foregoing description features a collapsible zone 140 which is longitudinally bounded by the more footward and more headward locations 84, 86. However as already noted the longitudinal extent of the collapsible zone can extend beyond locations 84, 86 and can include all the support bladders 54. Accordingly, deflation of the support zone can encompass deflation along the entire length of the mattress. In addition, the support zone bladders 54, rather than extending laterally across the entire width of the bed as seen in FIG. 3, can comprise a laterally left side support zone which comprises an array of bladders extending laterally from centerplane 46 to the left lateral edge of the bed and a laterally right side support zone which comprises an array of bladders extending laterally from centerplane 46 to the right lateral edge of the bed. With such an architecture deflation of the support bladders, whether longitudinally restricted or not, can be confined to one side of the bed, specifically the side of the bed on which the turn assist zone is inflated. In yet another variant at least some of the support bladders that are not deflated (e.g. bladders a through h and 1 through r of FIG. 10) can be overinflated (i.e. inflated to a pressure higher than normal operating pressure) to provide additional clearance between the occupant and the deflated bladders along reach-in space 72.

The user determined and discretionary periods of time elapse (blocks 154, 158) when the caregiver, having determined that the inflated turn assist bladders should be deflated and the deflated support zone 140 should be reinflated (typically as a result of having completed the care task), issues the second command by pressing the cancel or return button 114. In response, the controller operates the valves and/or compressor to concurrently deflate the inflated turn assist bladders and to reinflate the deflated support bladders of zone 140, thus returning the occupant support to its baseline state, i.e. to the state seen in FIG. 1. Deflation of the turn assist bladders and reinflation of the support zone 140 may occur concurrently, partially concurrently, or serially. Alternatively, separate control buttons could be provided to offer the caregiver a degree of control over the sequence.

As with the method described in the context of FIG. 8, FIG. 10 shows the occupant rotated onto his left side so that the caregiver can access the target region from the right side of the bed. Depending on the nature of the care activity, the caregiver may also need to move to the other (left) side of the bed and rotate the occupant onto his right side to complete the care activity.

Figure 12:
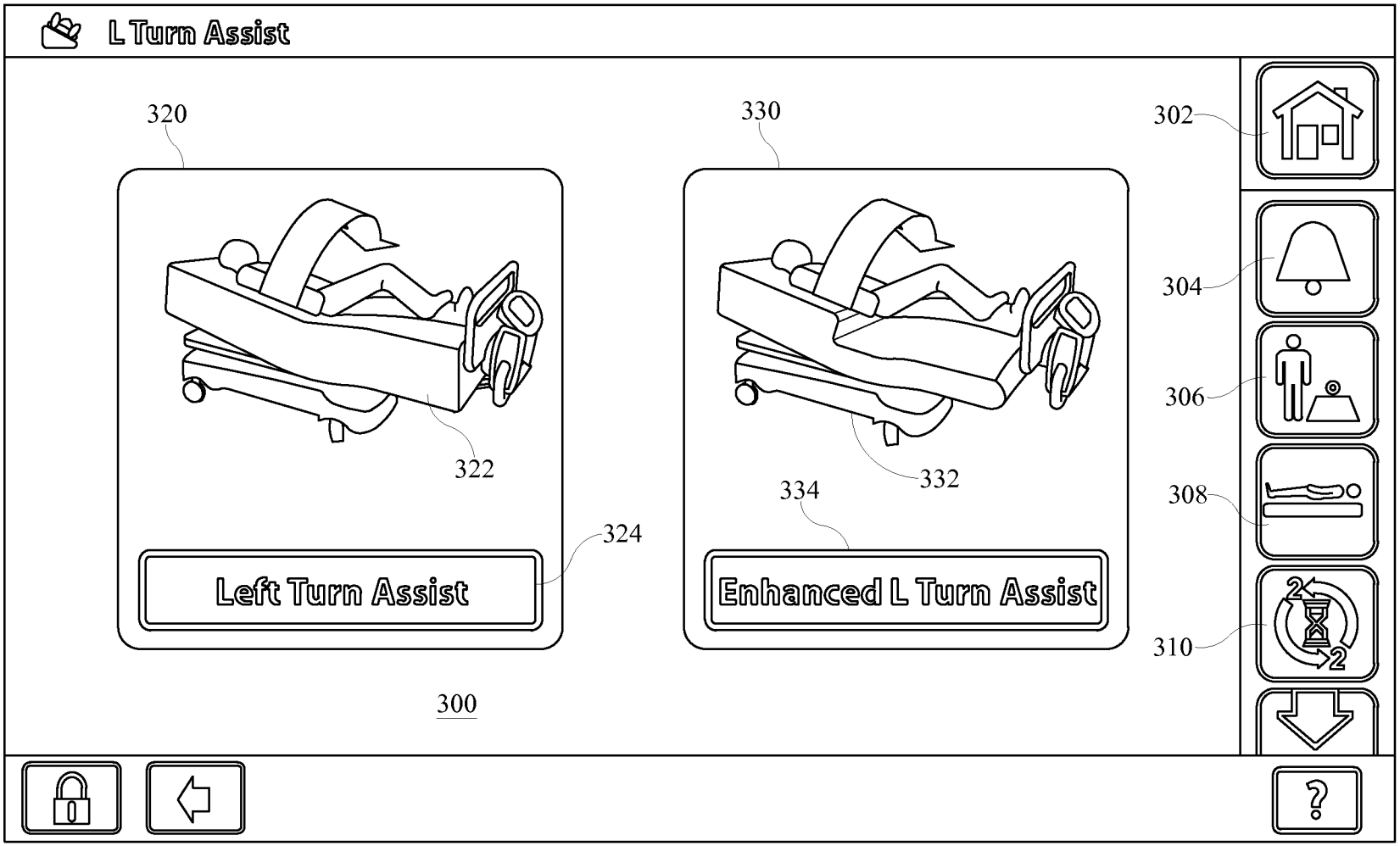
FIGS. 12-15 are illustrations related to graphical user interfaces/touch screen interfaces.
Figure 13:
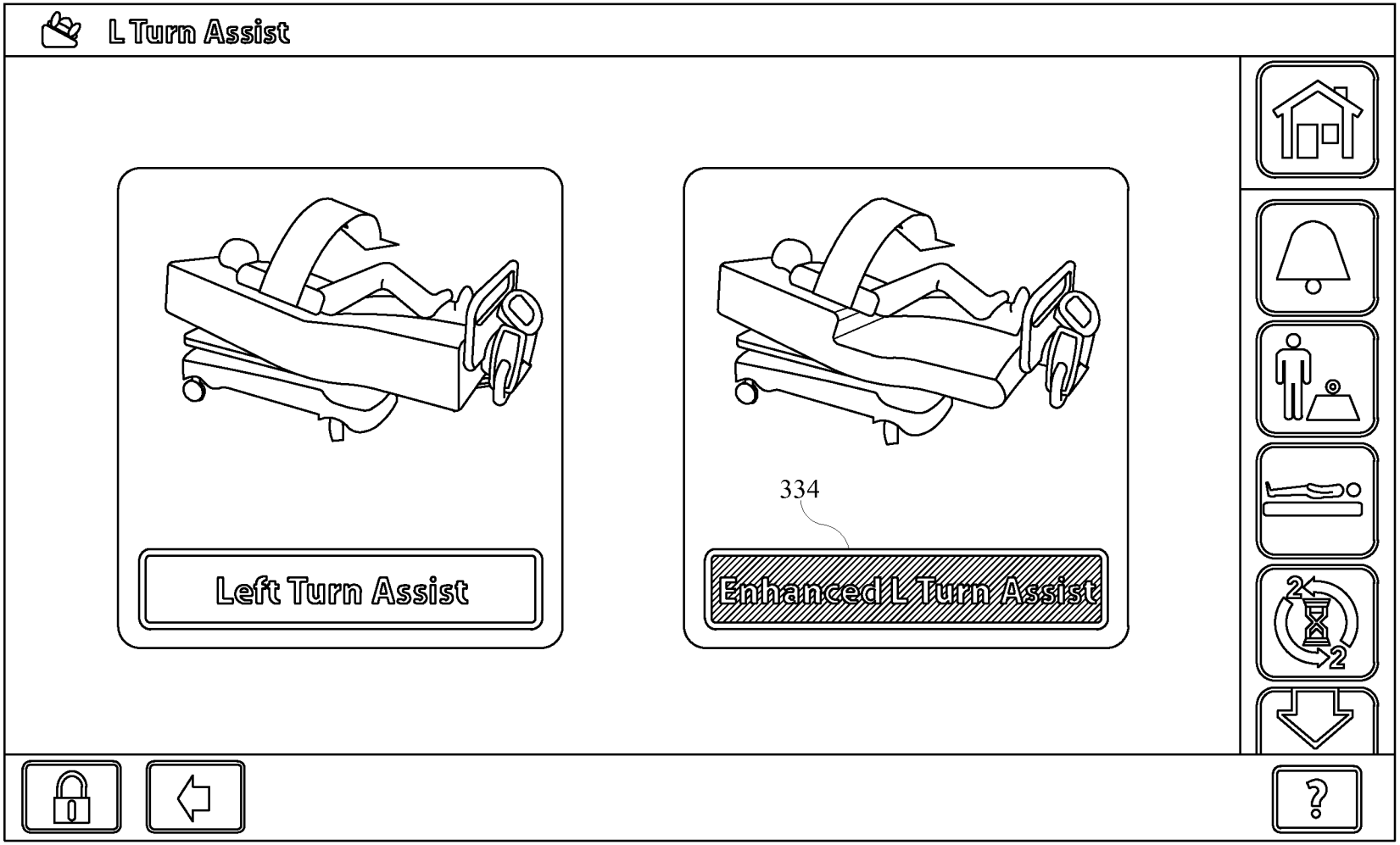
Figure 14:
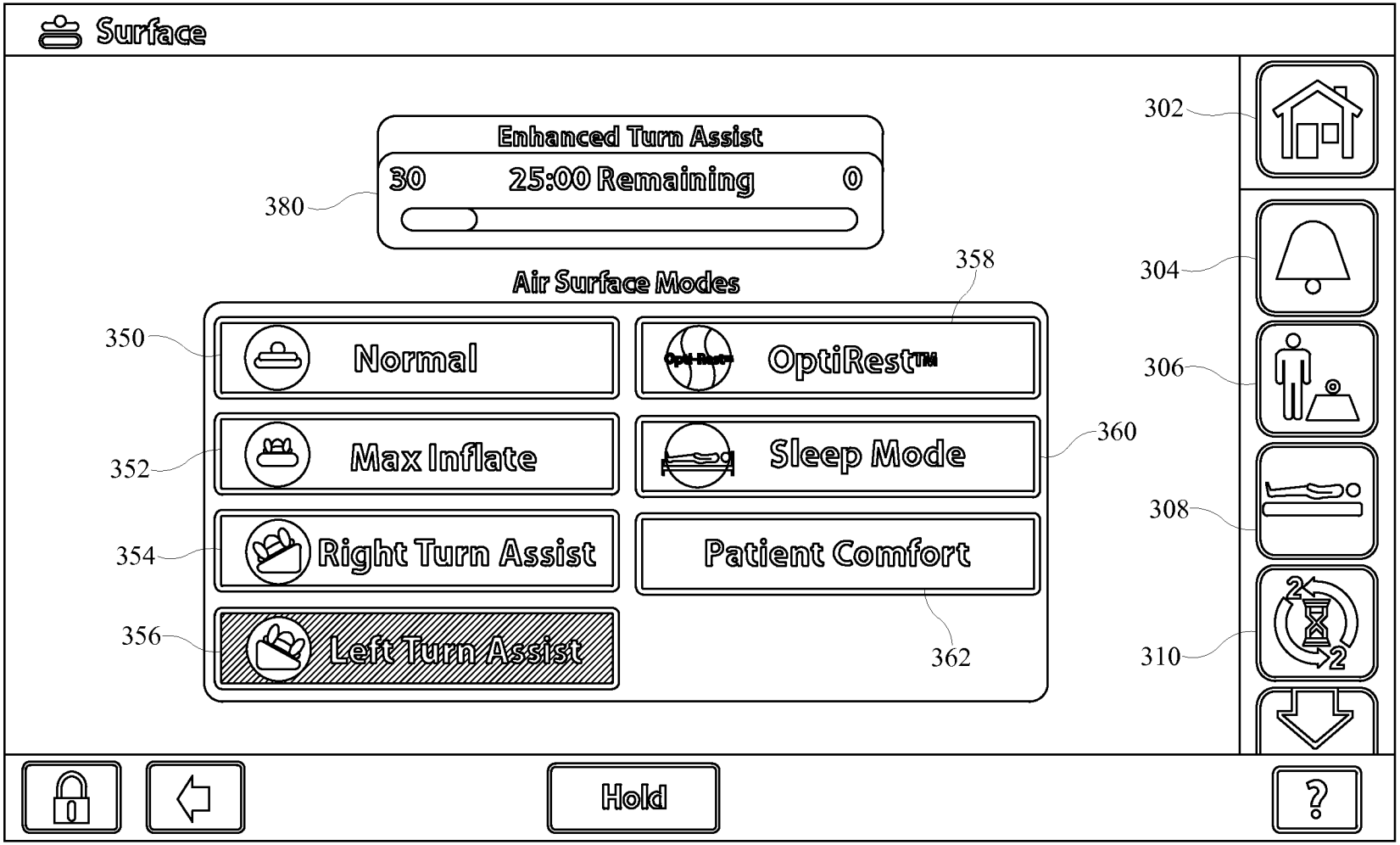
Figure 15:
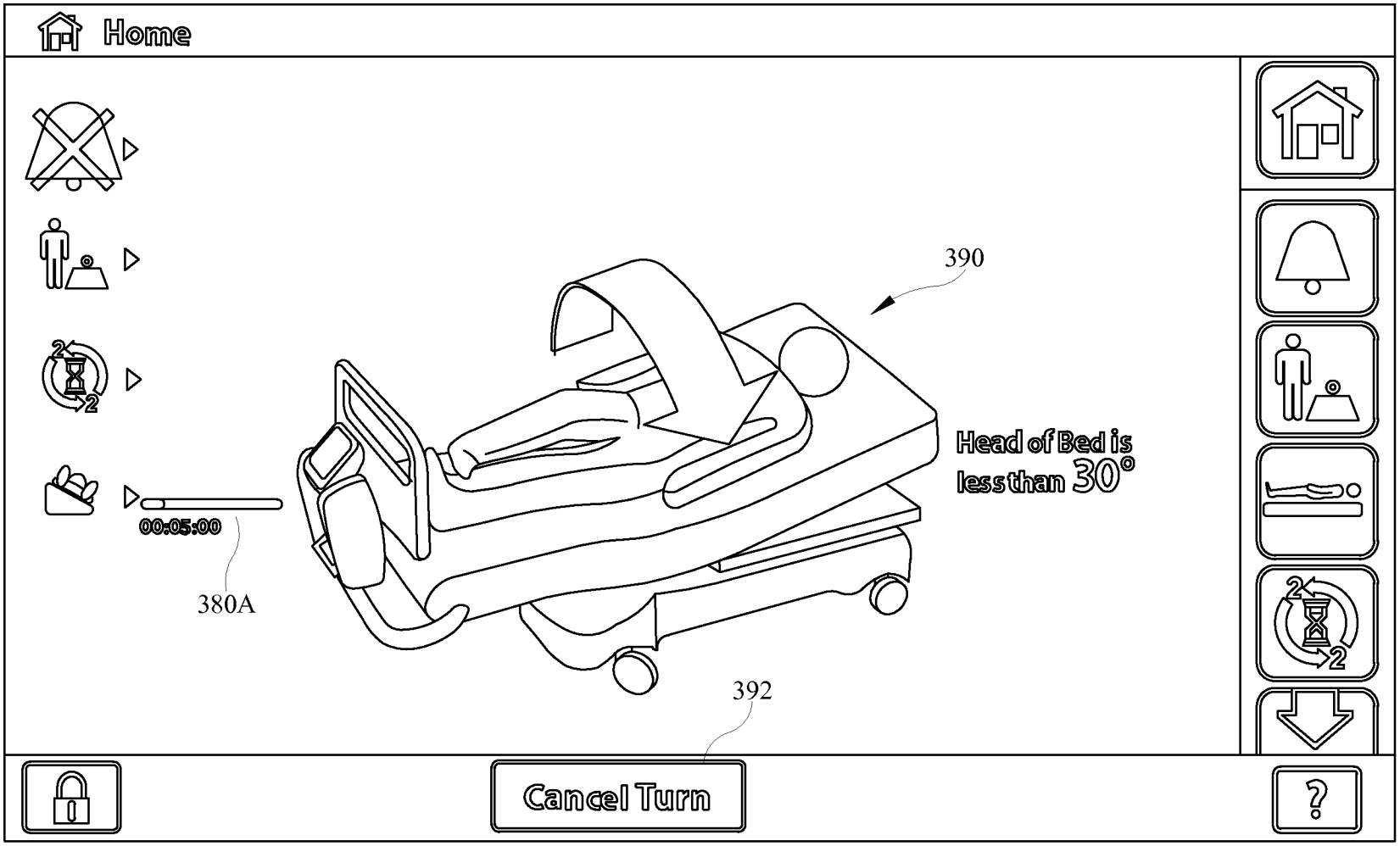

FIGS. 12-15 are related to graphical user interfaces/touch screen interfaces. FIG. 12 shows an interface display 300 with five touch sensitive icons 302, 304, 306, 308, 310 stacked vertically along the right side of the display. The center of the display is occupied by a pair of images. Left image 320 shows a graphic 322 of a bed occupant being turned to his left and includes a touch sensitive icon 324 labeled "Left Turn Assist". Right image 330 shows a graphic 332 of a bed occupant being turned to his left and includes a touch sensitive icon 334 labeled "Enhanced L Turn Assist". Graphic 322 and icon 324 are related to conventional turn assist operation. Graphic 332 and icon 334 are related to the enhanced turn assist operation described in the instant application for providing improved access to a target region of the occupant. FIG. 13 is the same as FIG. 12 but shows icon 334 in an illuminated state to reveal that a user has selected the enhanced mode of operation. Similar displays are used for right turn assist and enhanced right turn assist. FIG. 14 shows a display with icons 302 through 310 stacked along the right side of the display, but also shows seven touch sensitive icons 350, 352, 354, 356, 358, 360, 362, which allow a user to select among seven functions, two of which are right and left turn assist (icons 354, 356). Icon 356 is in an illuminated state to reveal that a turn assist function has been selected (which selection would have activated the display of FIG. 12). The display also includes a time meter 380 to indicate temporal progress. FIG. 15 is a display with a graphic 390 similar to graphic 332 of FIG. 12 but more magnified and from a different perspective. FIG. 15 also includes a time meter 380A similar to time meter 380 of FIG. 14 and also accompanied by text to indicate that the enhanced left turn assist mode has been selected. A touch sensitive "CANCEL" icon 392 is provided to allow a user to cancel operation.

Description of the Second Variant

Figure 16:
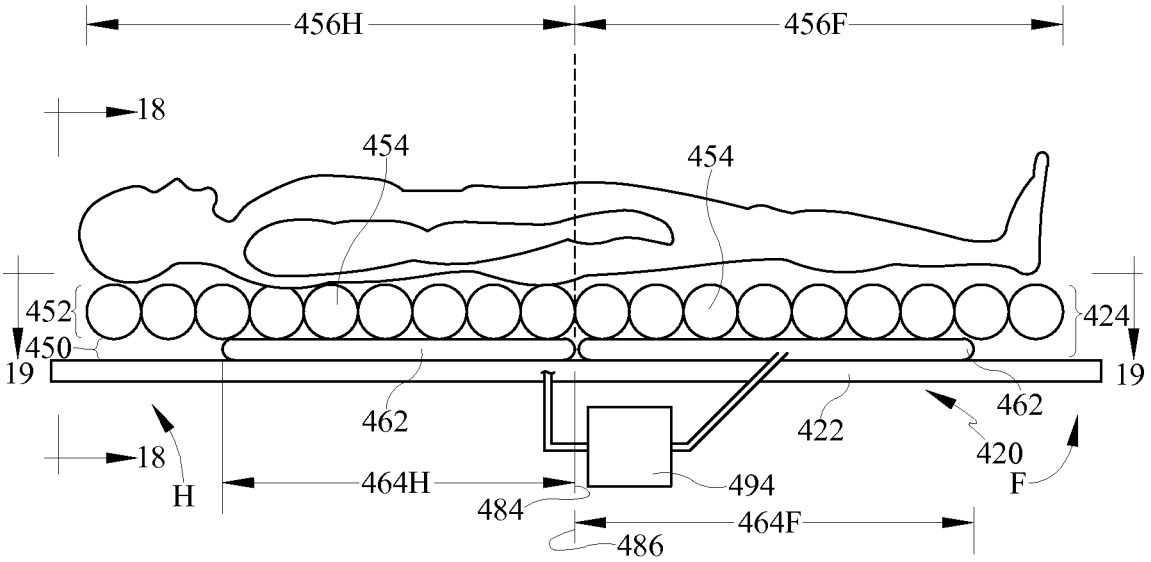
FIG. 16 is a schematic side elevation view showing a hospital bed deck and mattress in which the mattress comprises a turn assist layer shown in a deflated or depressurized state, and a support layer and also showing a supine occupant lying on the mattress.
Figure 17:
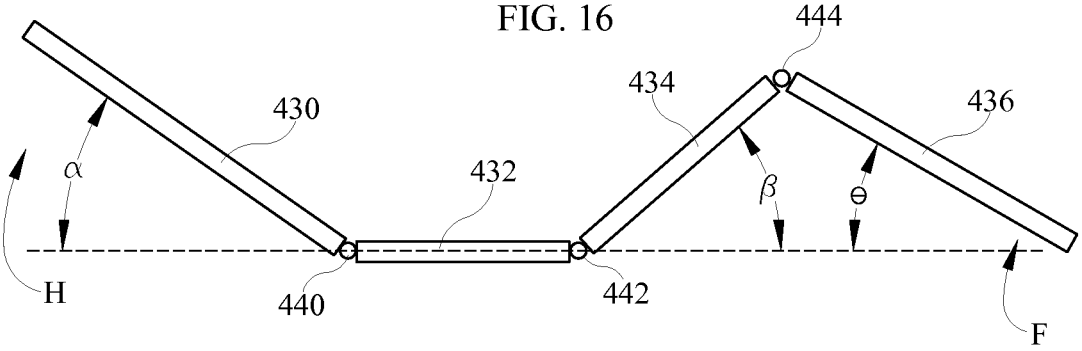
FIG. 17 is a side elevation view of a segmented deck for a hospital bed.

Referring to FIGS. 16-19 a hospital bed 420 includes a frame, not shown, a deck 422 supported on the frame, and occupant support or mattress 424. As seen in FIG. 17 deck 422 may be constructed of multiple segments such as an upper body or torso segment 430 corresponding to an occupant's torso, a seat segment 432 corresponding to an occupant's buttocks, a thigh segment 434 corresponding approximately to an occupant's thighs, and a calf/foot segment 436 corresponding to an occupant's calves and feet. The torso, thigh and calf sections are orientation adjustable about hinges 440, 442, 444 as indicated by angles $\alpha$, $\beta$, $\theta$ in FIG. 17. The bed extends longitudinally from a head end H to a foot end F and laterally from a left side L to a right side R. A notional centerplane 446, which contains a longitudinally extending centerline 448, shown at an arbitrary height, distinguishes left and right lateral sides of the bed and occupant support. The occupant support includes a turn assist layer 450 and a support layer 452 above the turn assist layer. The illustrated support layer is a set of longitudinally distributed inflatable and deflatable air bladders 454 but may be a foam layer or other alternative construction.

The occupant shown in FIG. 16 is a nominally positioned occupant. A nominally positioned occupant is one who is approximately laterally centered on the bed, i.e. one whose saggital plane approximately coincides with centerplane 446 when the occupant is supine on the mattress, and who is positioned longitudinally so that the positions of his or her anatomical features are compatible with the physical and/or functional features of the bed. For example, many beds include a hip indicator to indicate the approximate, desired longitudinal position of the occupant's hips. In another example the hinges 440, 442, 444 (FIG. 17) of beds having segmented decks are clear indicators of the approximate desired longitudinal position of the occupant's anatomical features (e.g. buttocks positioned between hinges 440, 442; popliteal region positioned over hinge 444).

Turn assist layer 450 includes a right side array 460 of two longitudinally distributed turn assist members 462 and a left side array 480 of two longitudinally distributed turn assist members. Left side array 480 and right side array 460 are substantially mirror images of each other. Accordingly, common reference numerals and symbols are used herein to refer to analogous components of the left and right arrays except when it is necessary to distinguish between left and right components or features, in which case a reference character L or R is appended to the reference numeral in question. Similarly, a reference character H or F is applied to reference numeral 462 when it is necessary to distinguish between the turn assist bladder closer to the head end of the bed and the turn assist bladder closer to the foot end of the bed on a given side of centerplane 446. On each lateral side of the bed turn assist bladder 462H corresponds to a headward turn assist zone 464H and turn assist bladder 462F corresponds to a footward turn assist zone 464F. Turn assist bladders 462H and zone 464H extend longitudinally along the occupant's torso and have a footward end 484 longitudinally aligned approximately with the occupant's sacral promontory or base of the occupant's sacrum. Zone 464F and turn assist bladder 462F have a headward end 486 that substantially abuts (abuts or is in close proximity to) footward end 484 of zone 464H/bladder 462H. Zone 464F extends footwardly from its headward end past the occupant's gluteal sulcus. As a result, the occupant's gluteal sulcus and sacrum are longitudinally within zone 464F.

A headward support bladder zone 456H corresponds to the support bladders 454 located more headwardly of ends 484, 486 of zones 464H, 464F. A footward support bladder zone 456F corresponds to the support bladders 454 located more footwardly of ends 484, 486 of zones 464H, 464F.

Figure 18:
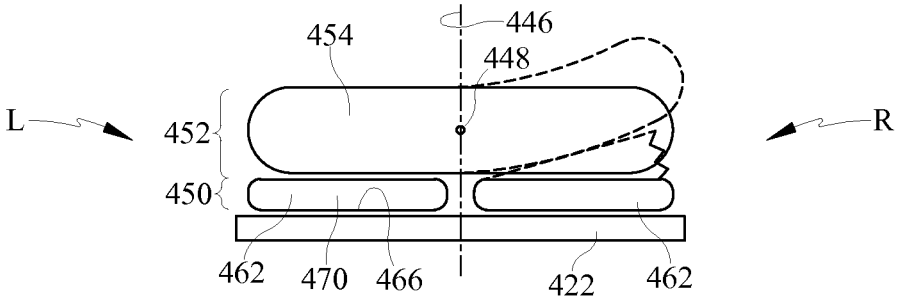
FIG. 18 is a view in direction 18-18 of FIG. 16 excluding the occupant and showing a right hand member of the turn assist layer in both a deflated state (solid lines) and an inflated state (dashed lines).
Figure 19:
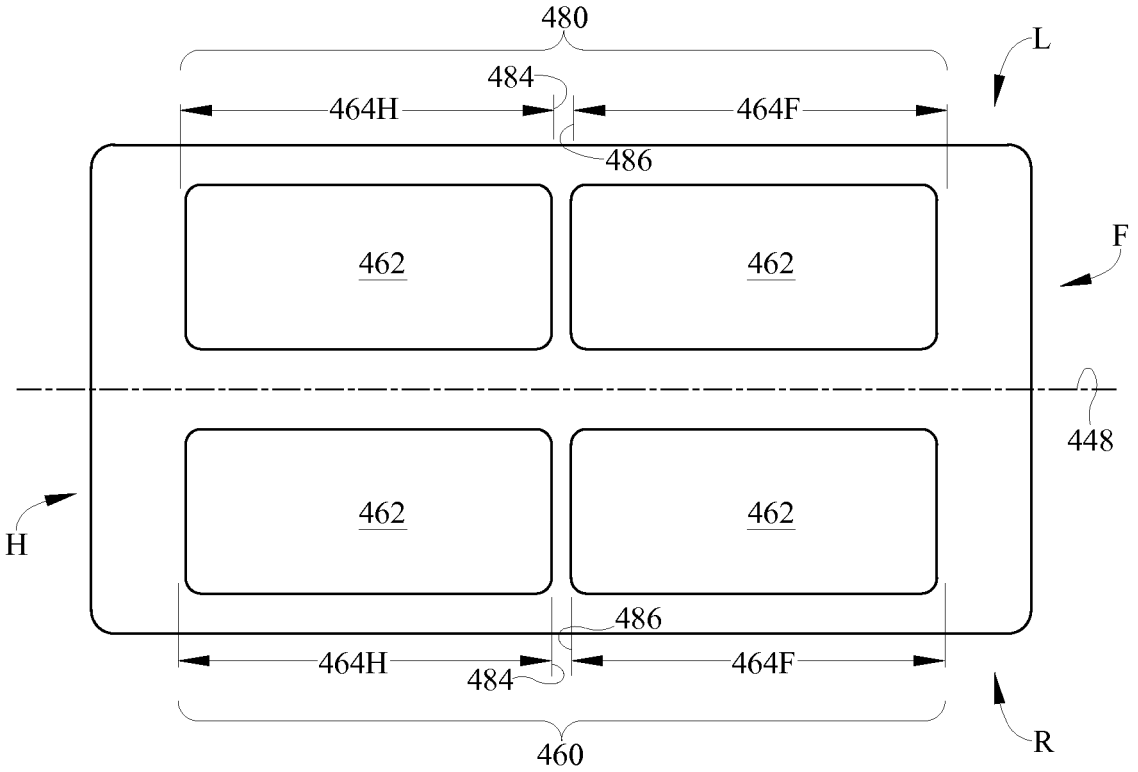
FIG. 19 is a schematic plan view of the turn assist layer in direction 19-19 of FIG. 16.
Figure 20:
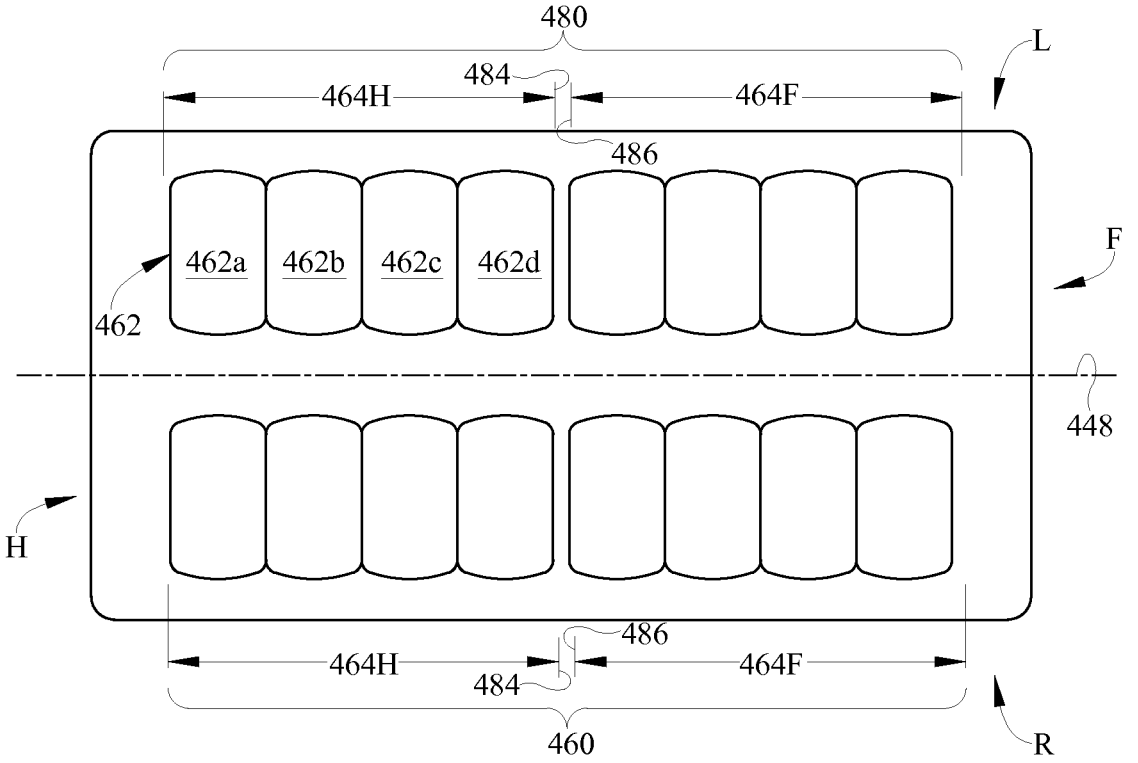
FIG. 20 is a schematic plan view similar to that of FIG. 19 showing an alternative turn assist layer architecture.

Each turn assist member 462 is a single inflatable and deflatable bladder as seen in FIG. 19 but may instead be an assembly of multiple bladders as seen in FIG. 20. Each bladder 462 comprises a casing 466 (FIG. 18) which bounds a volume of space 470. The contents of space 470 consists essentially of a bladder pressurizing medium such as air, some amount of which is present even when the bladder is in its deflated state (FIG. 16 and FIG. 18, solid lines). Alternatively the deflated state may be achieved by evacuating space 470 of air until a vacuum is achieved. Either way, volume 470 is substantially devoid of load bearing features, other than pressurized air, for supporting the weight of an occupant.

Figure 21:
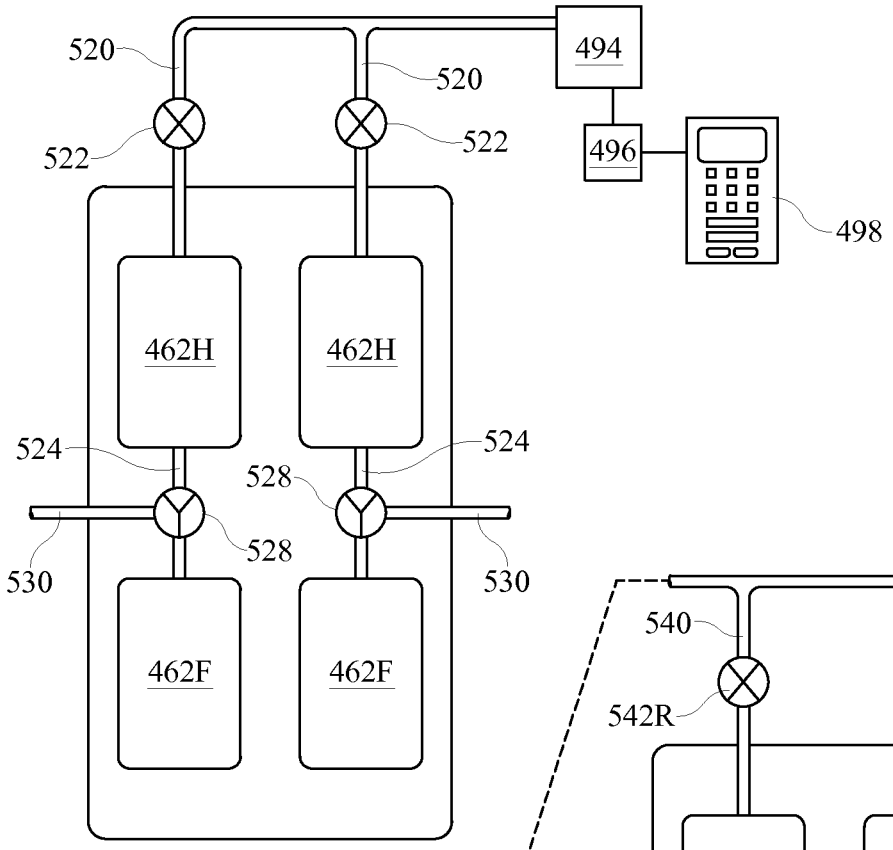
FIG. 21 is a schematic plan view similar to that of FIG. 19 showing one possible arrangement of conduits and valves for inflating and deflating bladders of the turn assist layer.
Figure 22:
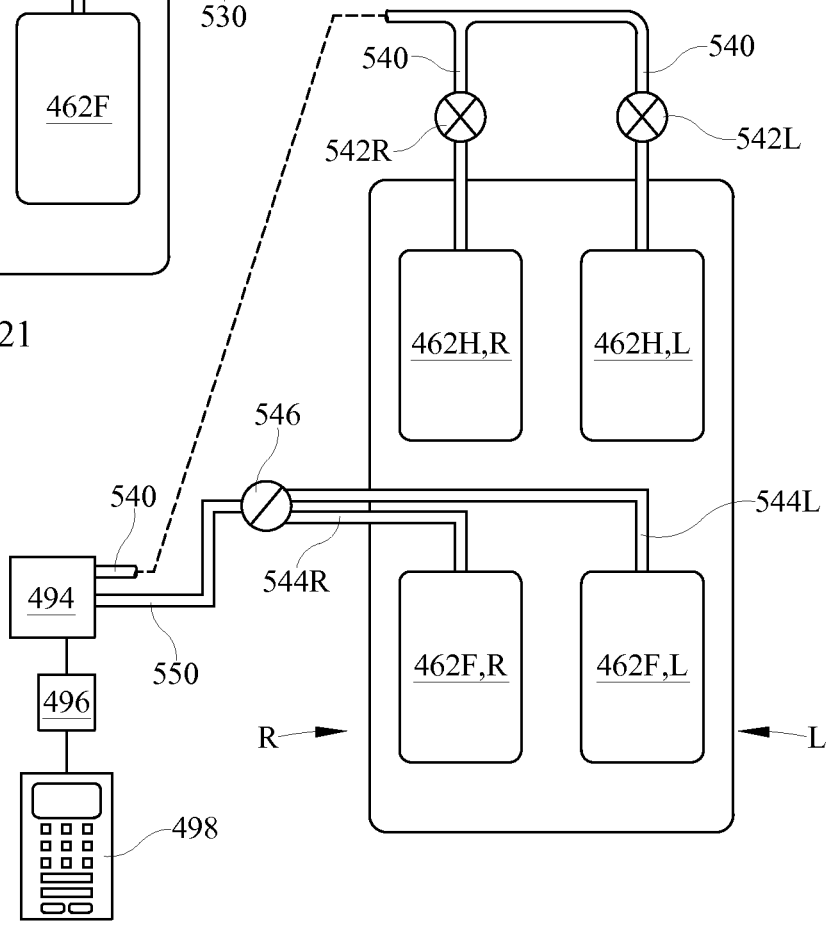
FIG. 22 is a schematic plan view similar to that of FIG. 21 showing an alternative arrangement of conduits and valves for inflating and deflating bladders of the turn assist layer.

Referring additionally to FIGS. 21-22, the bed also includes a compressor 494, various conduits (520, 524, 530 in FIG. 21; 540, 544, 550 in FIG. 22) and valves (522, 528 in FIG. 21; 542, 546 in FIG. 22) for regulating fluid flow through the conduits. The occupant support also includes a controller 496 and a user interface device 498 by means of which a user can issue commands to the controller. The controller operates the valves and compressor in response to user commands entered by way of user interface device 498.

Figure 24:
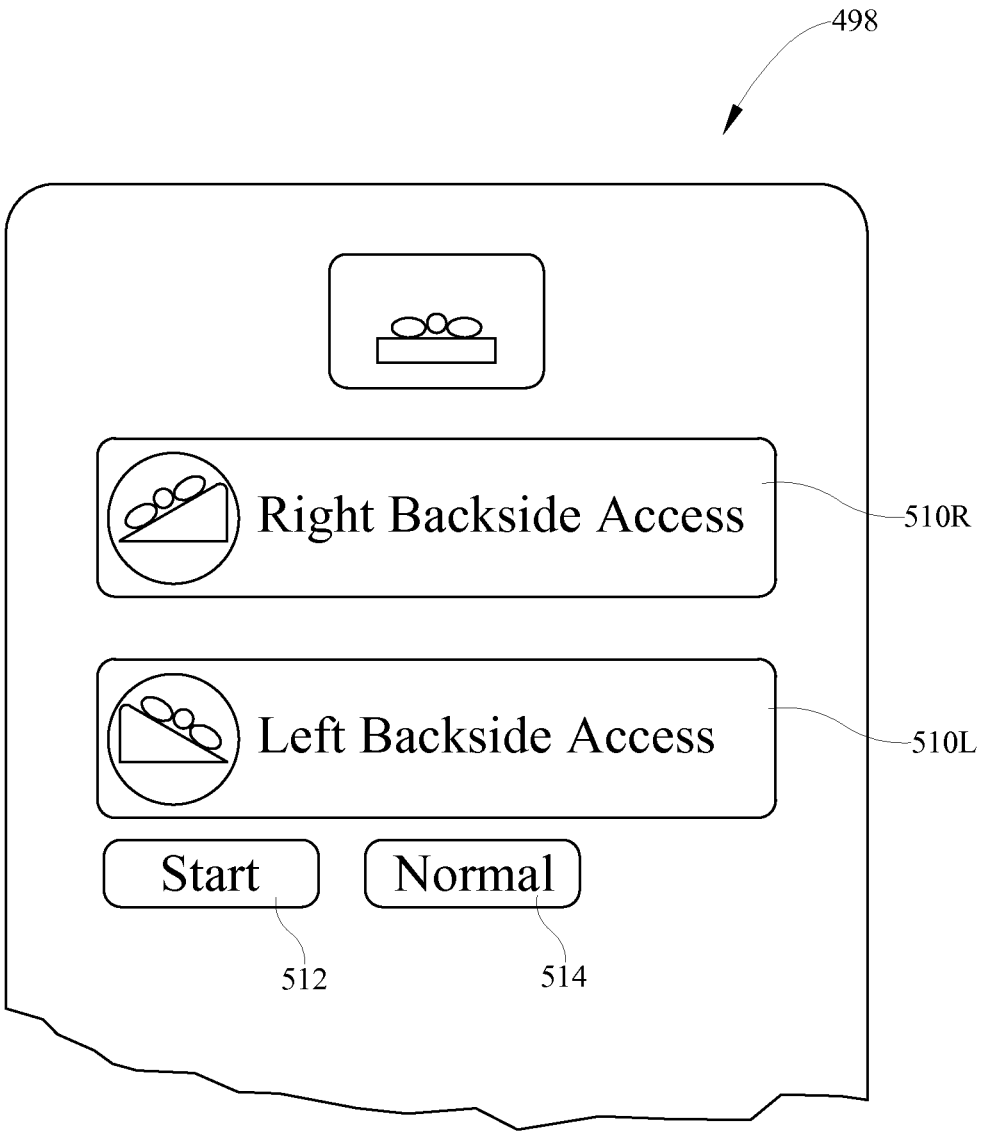
FIG. 24 is a view showing example elements of a user interface display.
Figure 25:
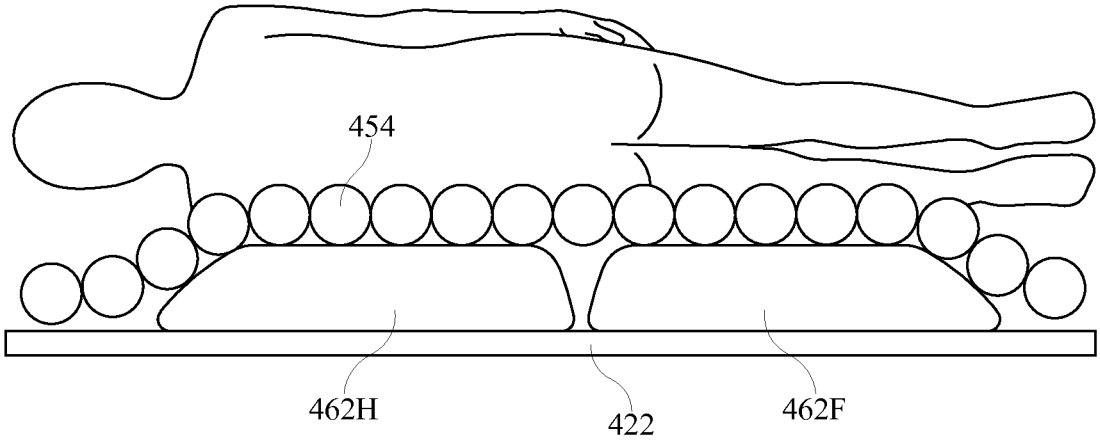
FIG. 25 is a view similar to that of FIG. 16 showing the turn assist layer having been inflated to rotate the occupant to his left.

FIG. 24 shows the appearance of an example user interface display. The display includes a left and right select buttons 510L, 510R enabling a user to select left side operation, which will rotate the occupant to his or her right to provide access to a target region from the left side of the bed, or right side operation which will rotate the occupant to his or her left to provide access to the target region from the right side of the bed. The display also includes a start button 512 and a cancel or return or normal button 514.

Figure 26:
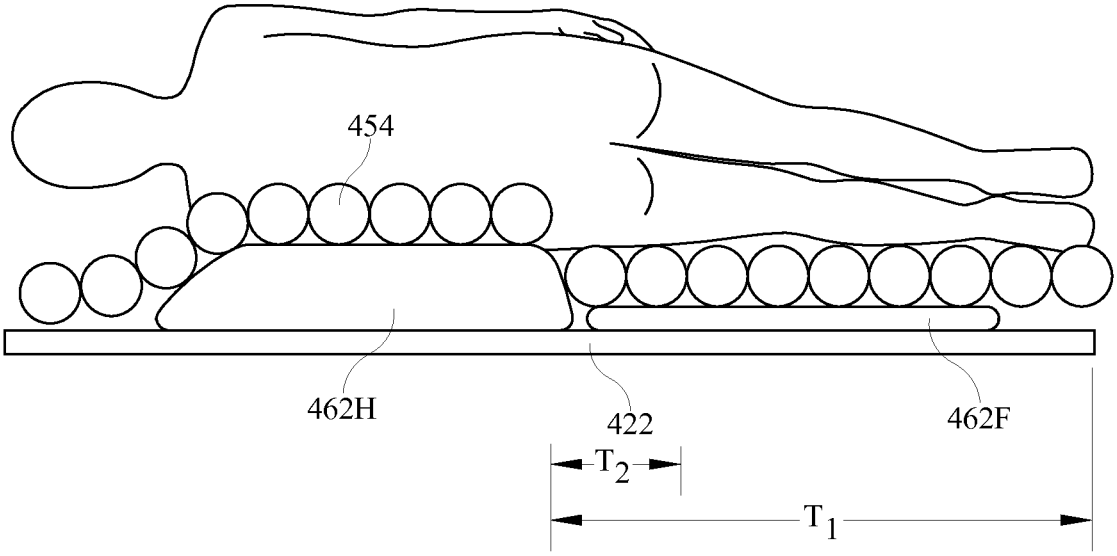
FIG. 26 is a view similar to that of FIG. 25 showing part of the turn assist layer having been deflated to provide access to a target region of the occupant and/or mattress.

Operation of the occupant support can be appreciated by considering an arrangement comprising two bladders on each lateral side of centerplane 446, as seen in FIG. 19, and an occupant nominally positioned on the occupant support. Referring principally to FIGS. 19, 24-26 and the block diagram of FIG. 27, controller 496 is adapted to pressurize and therefore inflate the turn assist bladders 462 of a selected one of the arrays (left or right) of turn assist members in response to at least one user command. For example, a user selects left or right side operation by pressing the appropriate left or right select button 510L or 510R (block 600 of the block diagram) and issues a single user command (corresponding to block diagram block 602) by pressing start button 512. In response to the single command, controller 496 operates the compressor and the appropriate valves, as discussed in more detail below, to concurrently pressurize and therefore inflate turn assist bladders 462H, 462F on the selected side (left or right) of the occupant support (block diagram block 602). The inflation pressure may be scheduled as a function of occupant height and/or weight. Once inflated, the bladders exhibit a lateral variation in height which increases with increasing lateral distance from centerplane 446 as seen in FIG. 18 (dashed lines). As a result the occupant is rotated from the supine position of FIG. 16 to a position seen in FIG. 25 in which the occupant is supported on his side by the inflated turn assist bladders. The controller subsequently deflates one of the bladders (block diagram block 608), for example bladder 462F in response to the same single user command. As a result, and as seen in FIG. 26, the occupant's torso continues to be supported by bladder 462H. Because the occupant's buttocks and legs are no longer supported, those portions of the occupant's body may rotate slightly back toward the supine position of FIG. 16, but will nevertheless remain near the rotated position they attained prior to deflation of bladder 462F. Consequently, a target region T1 longitudinally coextensive with the occupant's buttocks and legs is exposed and made accessible to a caregiver. As previously noted, the phrase "target region" refers to a portion of the patient and also to a substantially longitudinally coextensive portion of the mattress. Target region T1 includes a smaller target region T2 of particular interest, namely the region between the occupant's gluteal sulcus and sacral base or sacral promontory.

Figure 28:
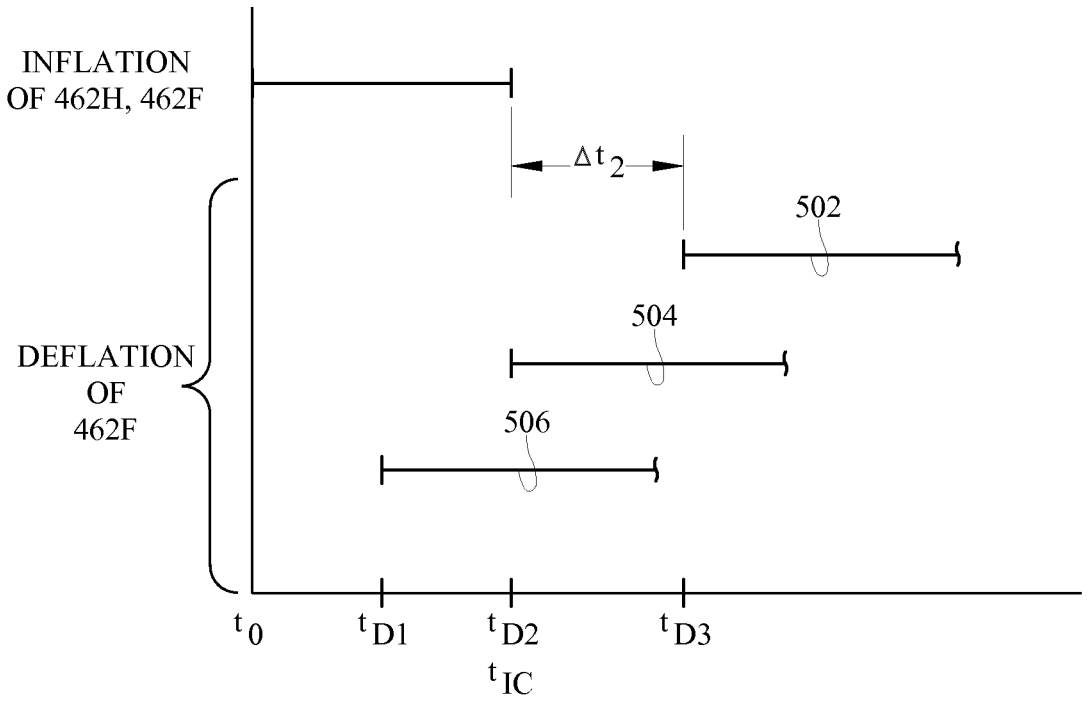
FIG. 28 is a graph showing variations in the temporal relationship between the inflation of the turn assist layer to attain the state of FIG. 25 and deflation of part of the turn assist layer to attain the state of FIG. 26.

FIG. 28 shows variations in the temporal relationship between the inflation of bladders 462H, 462F and the subsequent and deflation of bladder 462F and clarifies that "subsequently", when used to describe the deflation of bladder 462F, means that the onset of deflation of bladder 462F occurs after the onset of inflation of bladders 462H and 462F, but does not necessarily require the deflation of bladder 462F to begin later than the time at which bladders 462H and 462F attain a state of full inflation. Bladders 462H and 462F undergo inflation from time $t_0$ to time $t_{IC}$. The controller may observe a time delay $\Delta t_2$ between completion of inflation of turn assist bladders 462H, 462F and the onset of deflation, at time $t_{D3}$, of turn assist bladder 462F (time interval 502). In one embodiment $\Delta t_2$ is about 10 seconds. Alternatively the controller may begin subsequent deflation of bladder 462F essentially at time $t_{D2}$ (time interval 504) which is the same as time $t_{IC}$. A third option is to begin deflating bladder 462F before it is fully inflated while continuing to inflate bladder 462H (time interval 506).

In principle the controller could be configured to inflate only one of the two bladders of the selected bladder array, however such operation is thought to be less desirable than inflating both (or all) bladders of the selected bladder array and subsequently deflating a subset of the previously inflated bladders because inflating only one bladder could twist the occupant.

Figure 27:
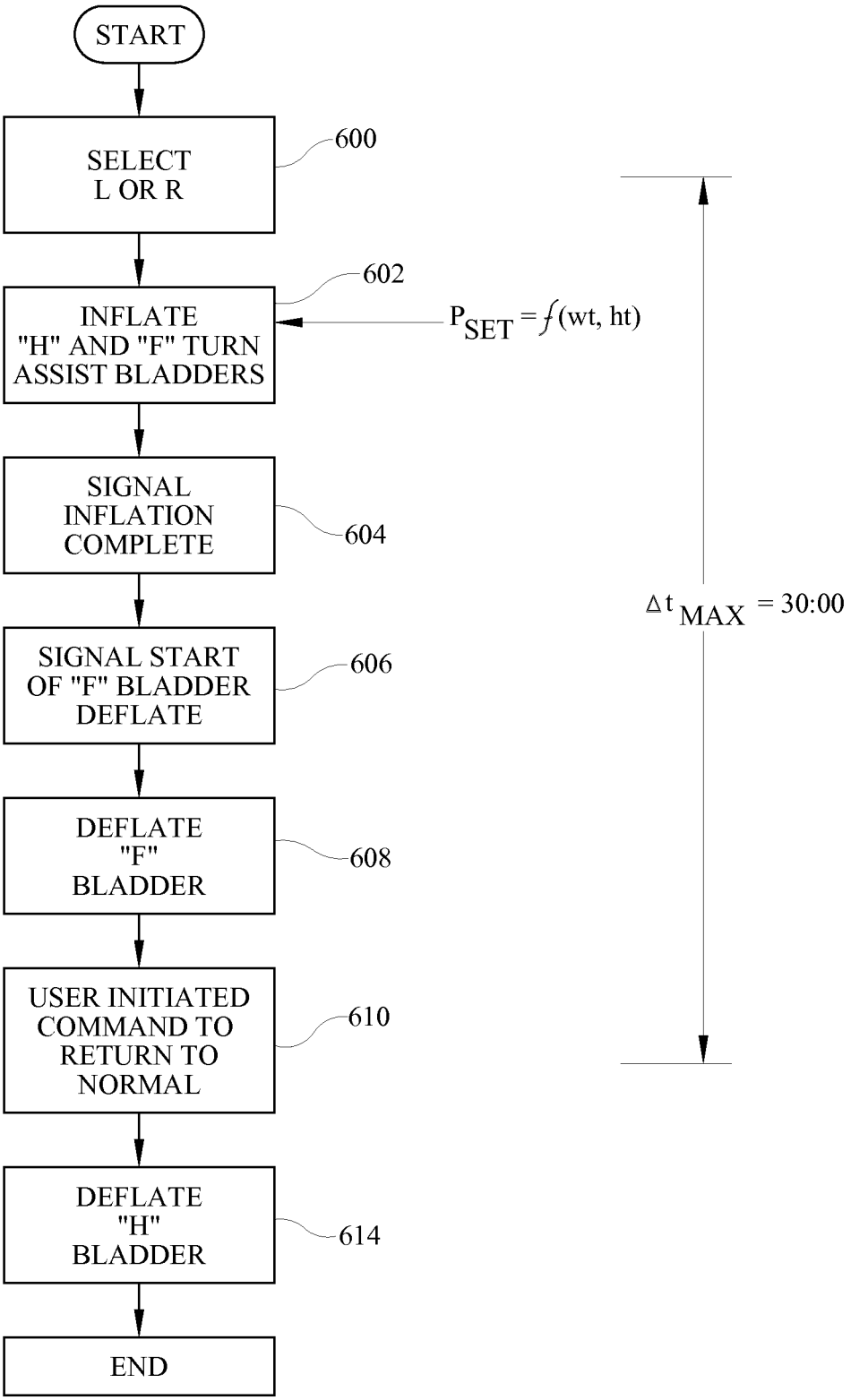
FIG. 27 is a block diagram showing steps of a method for transitioning between the state of the occupant and occupant support shown in FIG. 16 and that shown in FIG. 26.

As indicated at blocks 604 and 606 of FIG. 27 the controller may also be adapted to issue an inflation completion signal at time $t_2$ to signify completion of inflation of the turn assist bladders and/or to issue a deflation onset signal to signify imminent or actual onset of the deflation of one of the turn assist bladders. One example of such signals is an audible tone.

In the foregoing example the at least one user command comprises a single command that causes inflation of both turn assist bladders and subsequent deflation of one turn assist bladder. Alternatively, the at least one user command may comprise an initial command for causing the controller to effect inflation of both turn assist bladders and an intermediate user command for causing the controller to effect the deflation of one of the turn assist bladders. Such an arrangement requires the caregiver to take two command actions rather than one, but gives the caregiver control over time interval $\Delta t$.

One variant of the occupant support is to dispense with start button 512 (FIG. 24) and initiate pressurization and inflation of left or right turn assist bladders 462H, 462F in response to the user's selection of left or right side inflation. In other words a user's use of the left or right select button 510L, 510R not only selects the left or right side but also causes pressurization of the turn assist bladders on that side and subsequent deflation of one of the bladders, e.g. bladder 462F. Therefore, if the controller is configured to respond to a single user command, that single user command is a combination of the select command and the bladder inflation/subsequent deflation command. If the controller is instead configured to respond to an initial command and an intermediate command, the initial command is a combination of the select command and the bladder inflation command. Other user interface arrangements may also be satisfactory.

The controller maintains inflation of bladder 462H and deflation of bladder 462F for a user determined period of time. The user determined period of time elapses when the caregiver, having determined that the inflated turn assist bladder 462H should be deflated (typically as a result of having completed the care task), issues a user initiated deflate command (block 610 of FIG. 27) by pressing the cancel or return button 514. In response, the controller operates the valves and/or compressor (e.g. of FIG. 21 or 22) to deflate the inflated turn assist bladder (block 614) thus returning the occupant and the occupant support to the baseline state seen in FIG. 16. FIG. 27 also shows a "timeout" limit of 30 minutes. If the user fails to press button 514 within 30 minutes of having initiated inflation of the turn assist bladders (e.g. by pressing button 512) the controller operates the valves and/or compressor to deflate inflated turn assist bladder 462H and return the occupant and the occupant support to the baseline state of FIG. 16.

Figure 29:
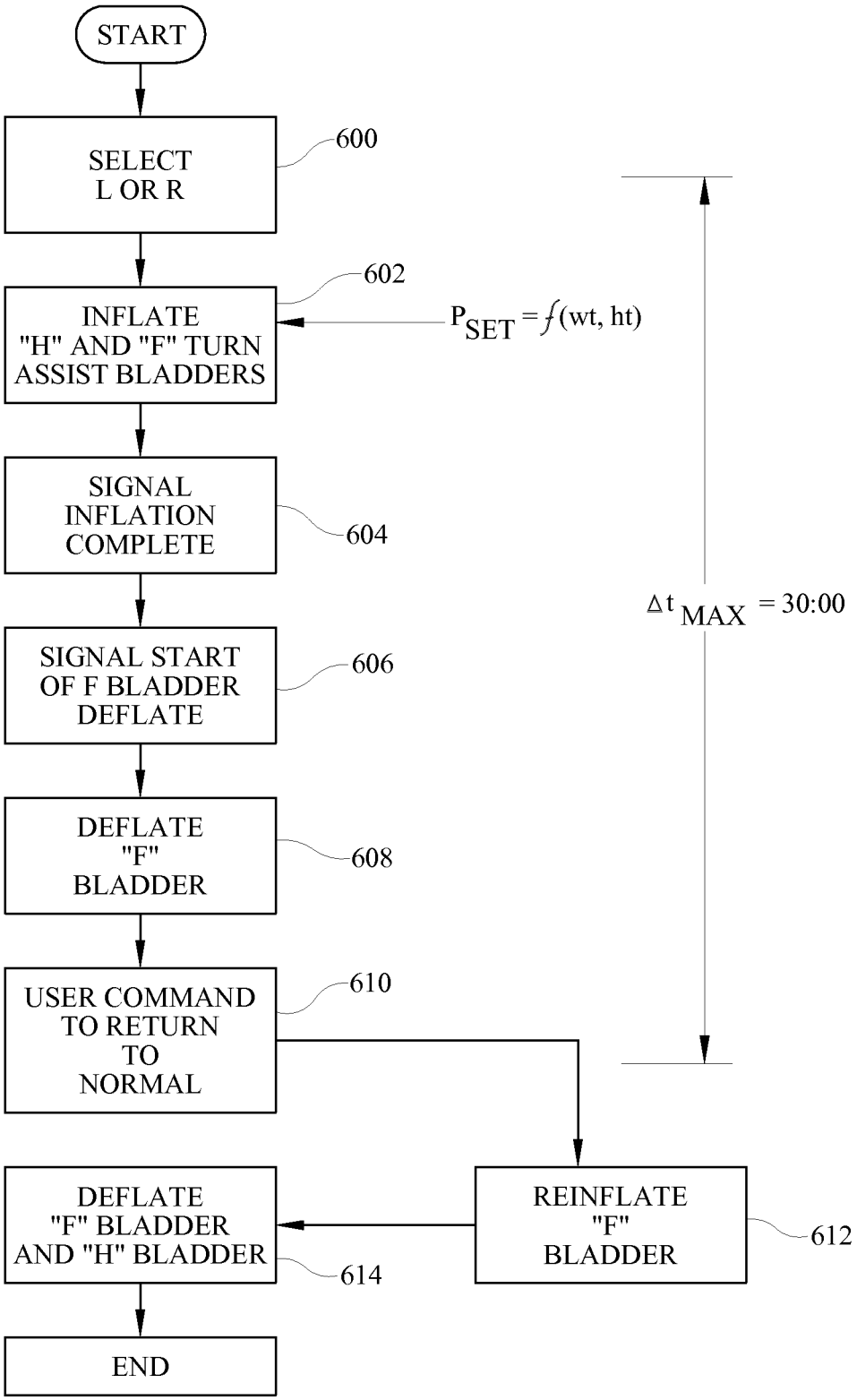
FIG. 29 is a block diagram similar to that of FIG. 27 showing an additional step of reinflating a previously deflated part of the turn assist layer and showing a modified step of deflating the turn assist layer to transition from the state of FIG. 26 to that of FIG. 16.

The block diagram of FIG. 29 shows an embodiment in which the controller reinflates turn assist bladder 462F (block 612) in response to the user initiated deflate command (block 610) before carrying out the deflation step at block 614. At block 614 the controller deflates both bladders 462H, 462F. As a result the occupant is fully supported along both zones 464H and 464F while being returned to the baseline state of FIG. 16. In all other respects the block diagram of FIG. 29 is the same as that of FIG. 27. In an alternative embodiment the controller is configured to reinflate turn assist bladder 462F in response to a user initiated reinflate command and to deflate bladders in response to a user initiated deflate command.

Figure 30:
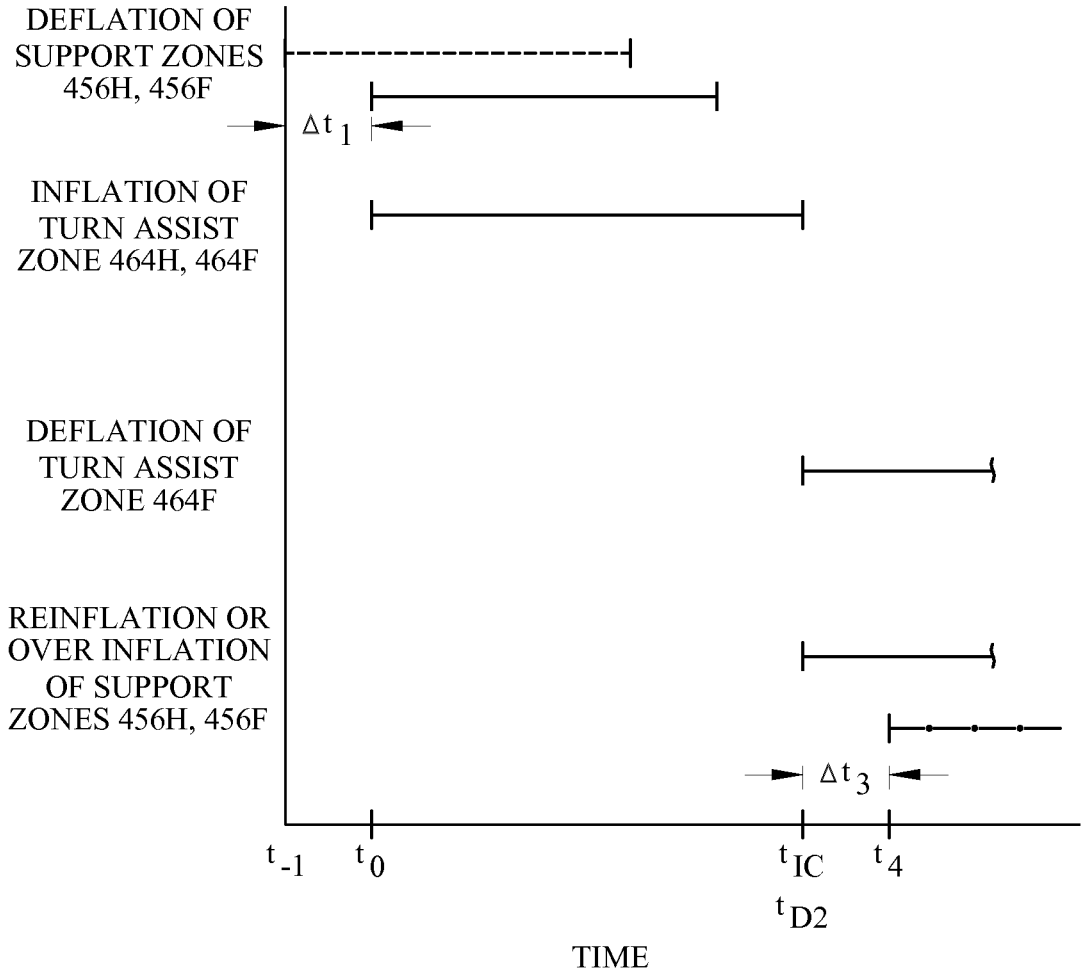
FIG. 30 is a graph showing example temporal sequences in which support bladder zones are inflated and deflated in coordination with inflation and deflation of turn assist zones.

If desired the controller may also be configured not only to inflate and deflate turn assist bladders 462H, 462F but to also inflate and deflate the support bladders in one or more support bladder zones 456H, 456F in coordination with the inflation and deflation of the turn assist bladders. Referring to FIG. 30, inflation of turn assist zones 464H, 464F (i.e. of turn assist bladders 462H, 462F) begins at time $t_0$. In addition, support zones 456H, 456F are deflated (or alternatively only support zone 456F is deflated) beginning either at time $t_0$ (solid line) or at a time $t_{-1}$ (dashed line) which is earlier than $t_0$ by $\Delta t_1$. Inflation of the turn assist zones is complete at time $t_{IC}$. Deflation of turn assist zone 464F begins at time $t_{D2}$, which is substantially the same as time $t_{IC}$. In addition, the previously deflated support zone 456H is reinflated (or alternatively zone 456F is not reinflated if only that zone had been previously deflated) and, if desired, overinflated (i.e. reinflated to a pressure higher than normal operating pressure) beginning at time $t_{D2}$ (solid line) or at a time $t_4$ (dash-dot line) which is later than time $t_{D2}$ by $\Delta t_3$. It is believed advisable to defer the onset of reinflation of support zones 456H, 456F until at least the time of onset of deflation of turn assist zone 464F. The onset of deflation of turn assist zone 464F may be delayed by $\Delta t_2$ relative to $t_{IC}$, as already described in connection with FIG. 28.

Figure 31:
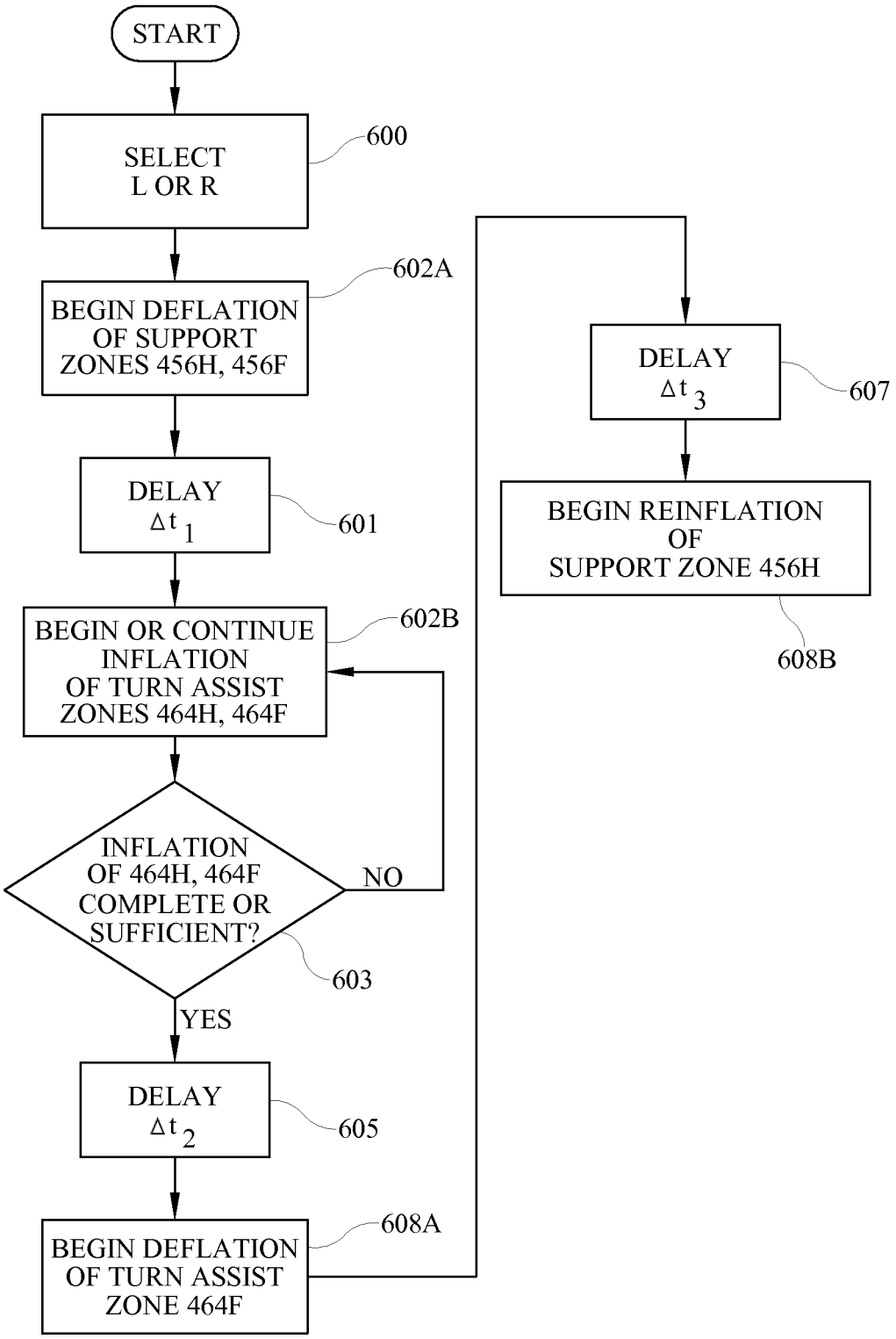
FIG. 31 is a block diagram of the operation shown in FIG. 30.

FIG. 31 shows the above described operation in block diagram form. At block 600 a user selects left or right operation. At block 602A, deflation of the support zones 456H, 456F begins (or alternatively deflation of only support zone 456F begins). At block 602B inflation of the turn assist zones begins. Once the inflation of the turn assist zones is complete or sufficiently complete (e.g. a specified percentage of the normal turn assist bladder inflation pressure has been attained) (block 603) deflation of turn assist zone 464F begins (block 608A). At block 608B, reinflation of support zone 456H, begins (or alternatively zone 456F is not reinflated if only that zone had been previously deflated). The support zones may be reinflated to their normal operating pressure or may be overinflated. As already noted one or more of the time delays $\Delta t_1$, $\Delta t_2$, $\Delta t_3$ at blocks 601, 605, 607 may be zero.

In the foregoing description the occupant has been rotated onto his left side so that the caregiver can access the target region from the right side of the bed. Depending on the nature of the care activity, the caregiver may also need to move to the other (left) side of the bed after having returned the bed and occupant to the baseline state of FIG. 16 and then rotate the occupant onto his right side to complete the care activity.

Returning to FIG. 21, one possible arrangement of components includes conduit 520 for establishing fluid communication between bladder 462H and compressor 494, and fill valves 522 for regulating fluid flow through the conduit. Intermember conduits 524, each with an intermember valve 528, extend between bladder 462H and bladder 462F. An exhaust conduit 530 extends from intermember valve 528 to atmosphere. In practice either the left bladder array or the right bladder array is selected. Thus the following operational description applies to either the left array or the right array but not to both arrays at the same time. A fill valve 522 is opened and corresponding intermember valve 528 is positioned to allow fluid communication between bladders 462H and 462F but to block fluid flow through exhaust conduit 530 in order to enable the compressor to pressurize bladders 462H, 462F. When the bladders are satisfactorily pressurized, fill valve 522 is closed and operation of the compressor is discontinued. Valve 528 is then positioned to vent air from bladder 462F thus deflating bladder 462F. Pressurization of the turn assist bladder 462H and deflation of bladder 462F is maintained until a user presses button 514 (FIG. 24). In response, the controller commands valve 528 to a position that opens a path between inflated bladder 462H and atmosphere thus venting and deflating bladder 462H. A different valve and conduit arrangement would be required for the previously mentioned, less preferred mode of operation in which fewer than all the bladders are initially inflated.

FIG. 22 shows another possible arrangement of components for supplying air to or exhausting air from bladders 462. The component arrangement includes first conduits 540 establishing fluid communication between head end bladders 462 and compressor 494, and first valves 542L, 542R for regulating fluid flow through the first conduit. A left supply and vent conduit 544L extends from left turn assist bladder 462F,L to switching valve 546. A right supply and vent conduit 544R extends from right turn assist bladder 462F,R to switching valve 546. The switching valve is also connected to a second conduit 550 which is connected to the compressor. In practice either the left bladder array or the right bladder array is selected. Thus the following operational description, which is specifically directed to the left array, applies to either the left array or the right array but not to both arrays at the same time. Valve 542L is opened thus establishing fluid communication between compressor 494 and bladder 462H,L. Switching valve 546 is positioned in a left fill position thus establishing fluid communication between the compressor and turn assist bladder 462F,L. The compressor is operated to pressurize bladders 462H,L and 462F,L. When the bladders are satisfactorily pressurized, first valve 542 is closed. The compressor is then operated to suction air from bladder 462F,L by way of conduits 544L and 550. Valve 546 is then closed and compressor operation is discontinued. When it is desired to deflate bladder 462H,L the controller commands valve 542L to a position that reestablishes fluid communication between the compressor and bladder 462H,L. The compressor is then operated to suction air out of bladder 462H,L.

Figure 23:
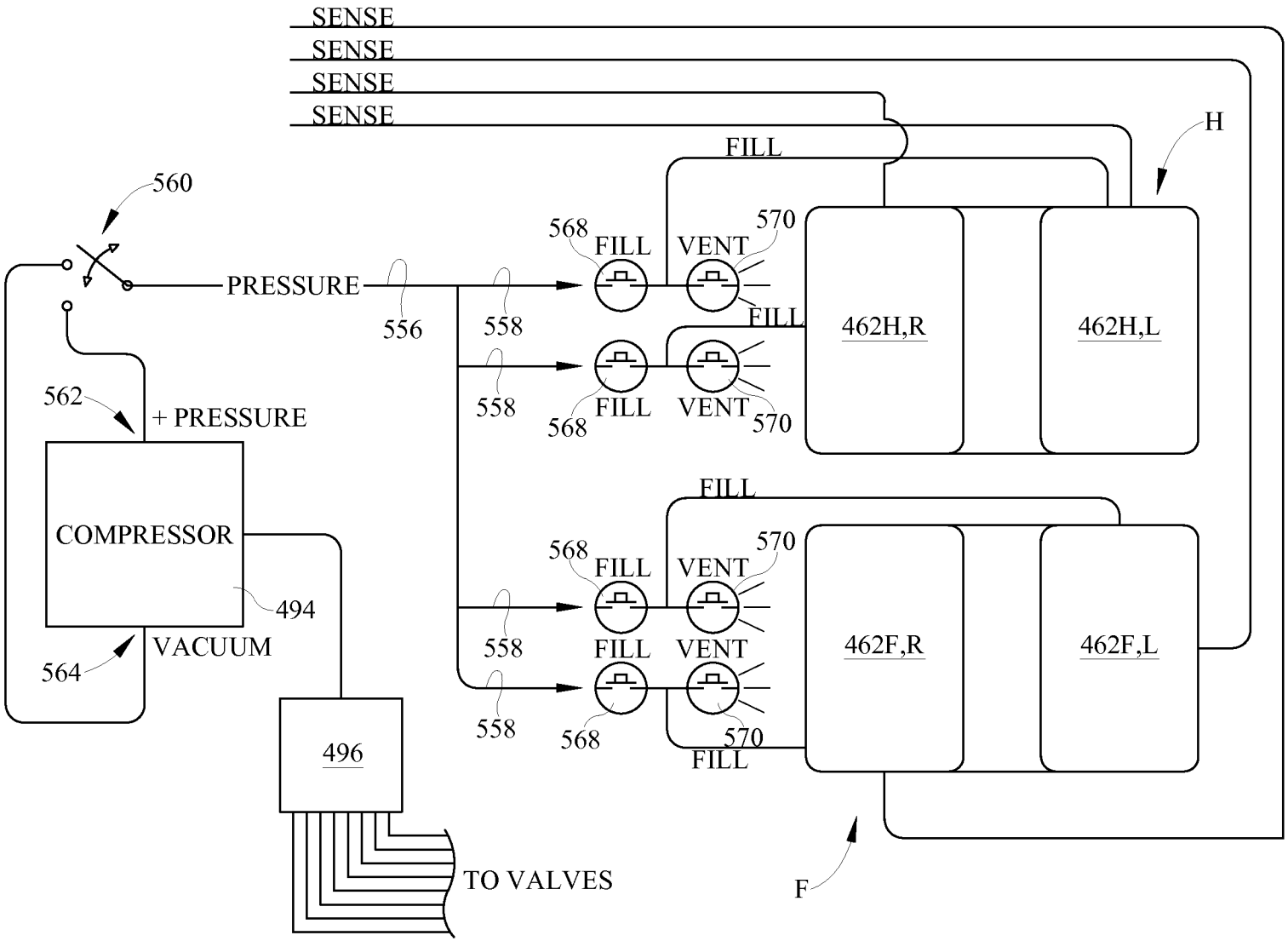
FIG. 23 is another schematic plan view showing yet another alternative arrangement of conduits and valves for inflating and deflating bladders of the turn assist layer.

FIG. 23 shows another possible arrangement of components for supplying air to or evacuating air from bladders 462. The arrangement includes a first conduit 556 extending from compressor 494 and having branches 558 connected to each of the four turn assist bladders 462. A switching valve 560 selectively connects the first conduit to either a pressure port 562 or a suction port 564 of the compressor. A main valve 568 regulates fluid flow between first conduit 156 and each bladder. A vent valve 570, which is normally closed, is connected to each branch line. To fill one or more bladders, the controller 496 causes switching valve 560 to connect first conduit 556 to the compressor pressure port, opens the main valve or valves 568 corresponding to the bladder or bladders to be filled, operates compressor 494 until the bladder is satisfactorily pressurized, and then closes the main valve. To evacuate air from one or more bladders the controller causes switching valve 560 to connect first conduit 556 to the vacuum pressure port, opens the main valve or valves 568 corresponding to the bladder or bladders to be evacuated, operates compressor 494 until the bladder is satisfactorily depressurized, and then closes the main valve. Each vent valve 570 remains closed and is used to evacuate the associated bladder only in response to an interruption of electrical power to the bed.

Figure 32:
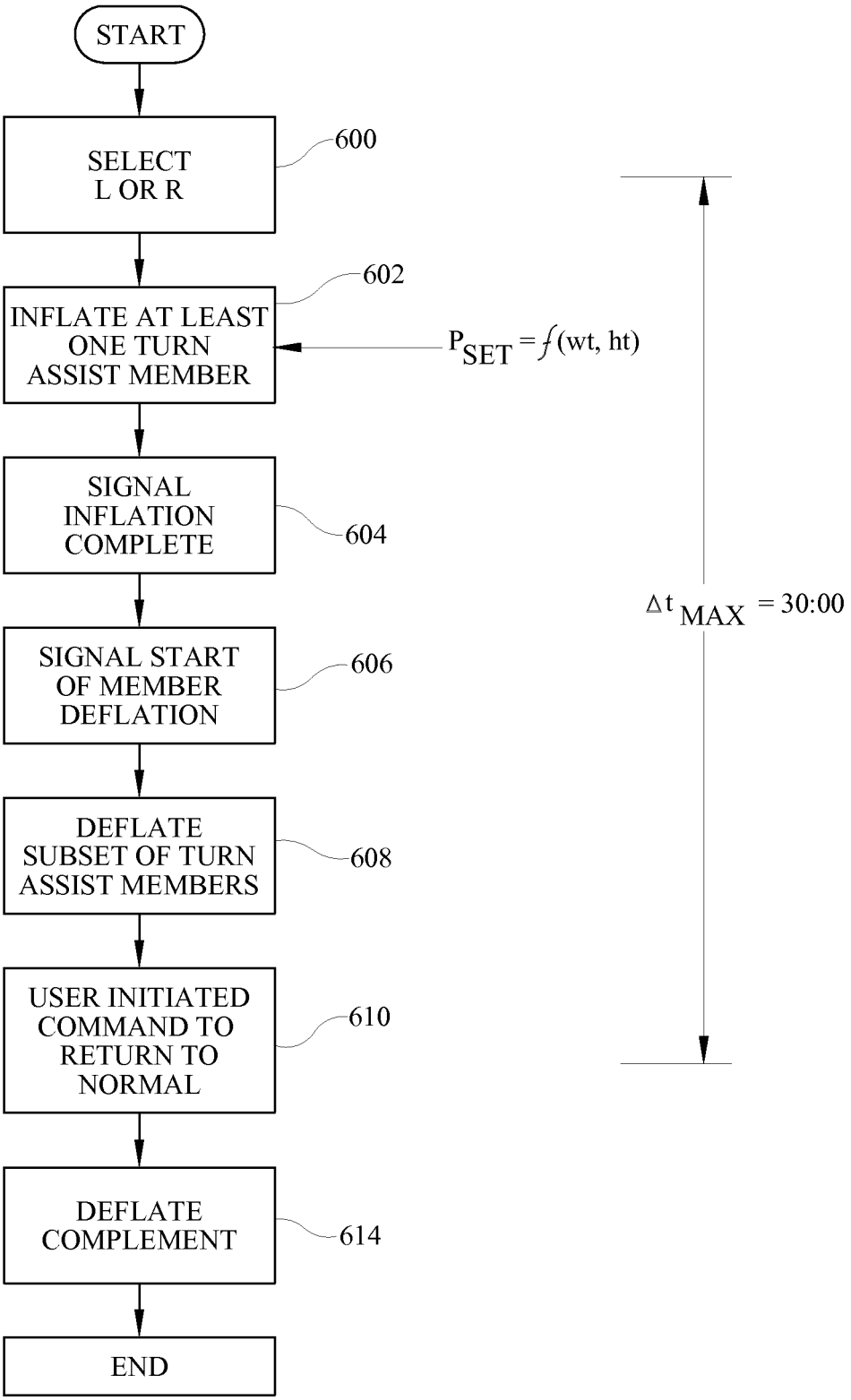
FIGS. 32, 33 and 34 are block diagrams showing generalizations of the methods of FIGS. 27, 29, and 31 respectively.
Figure 33:
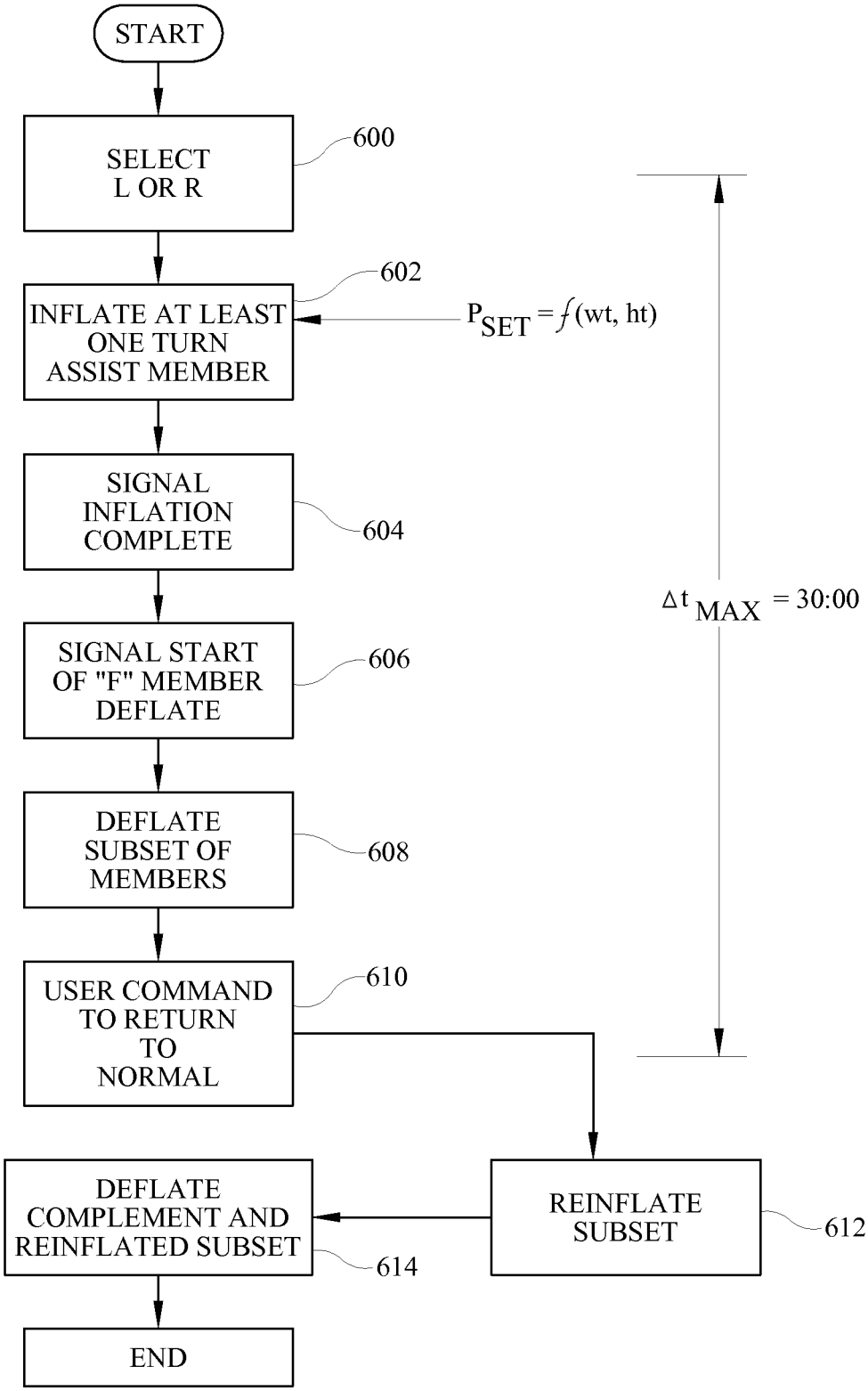
Figure 34:
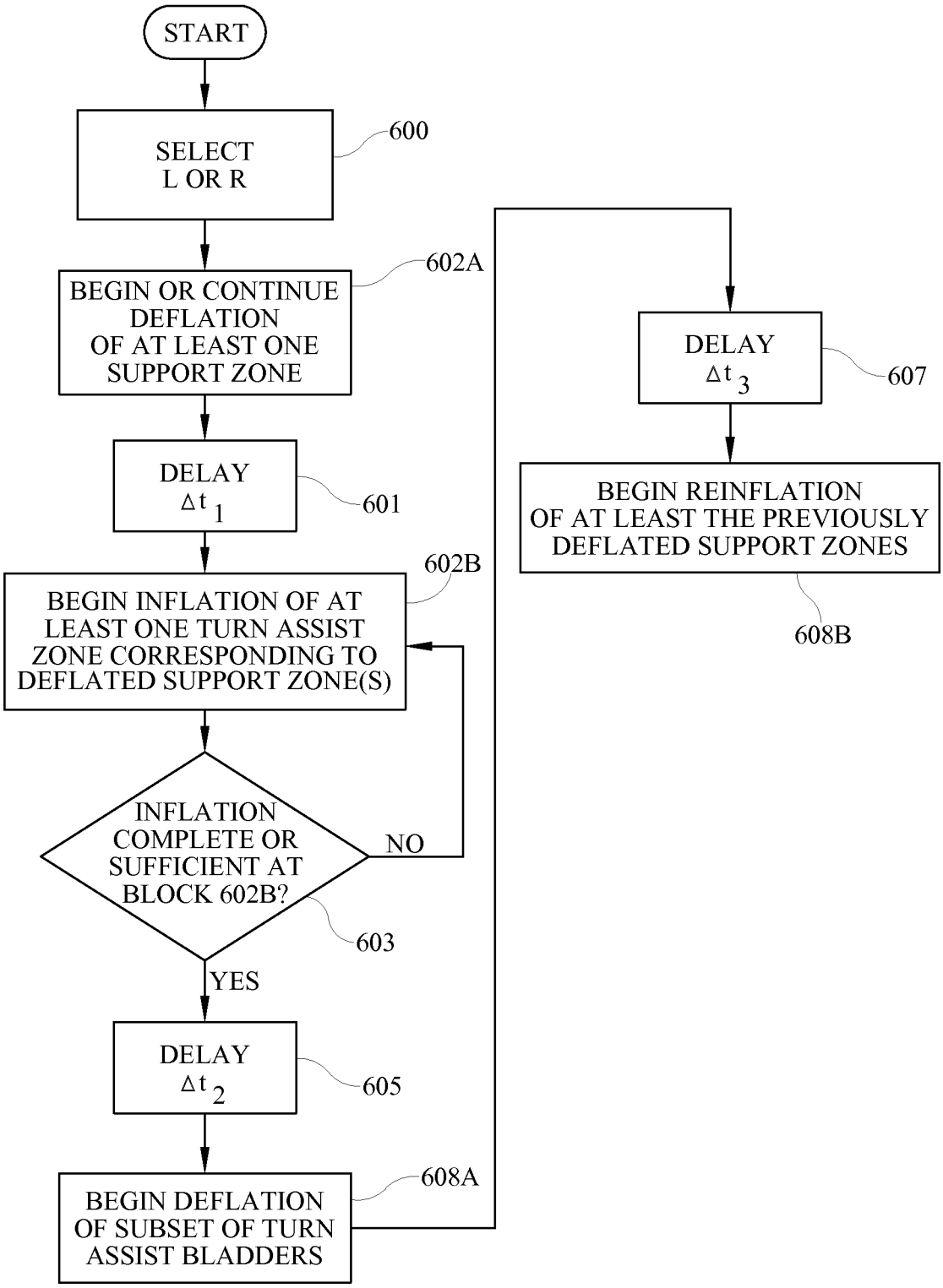

The foregoing description is based on an occupant support having exactly two turn assist members (bladders) on each lateral side of the occupant support. However the occupant support may have three or more turn assist members on each side. In general, as seen in the block diagram of FIG. 32, the controller inflates at least one turn assist member of a selected one of the left and right arrays (block 602) and subsequently deflates a subset of the more than one turn assist member in response to at least one user command (block 608). Irrespective of the quantity of bladders per side, the inflation of at least one turn assist member may comprise inflation of more than one turn assist member and, in the limit, may comprise inflation of all the turn assist members on a given (left or right) side of the occupant support. The controller is also configured to deflate the complement of the subset (i.e. the bladders that were not deflated at block 608) in response to the user initiated deflate command (blocks 610, 614). As seen in the block diagram of FIG. 33 the controller may also be configured to reinflate the subset of the turn assist members (block 612) and to deflate both the complement and the reinflated subset (block 614) in response to the user initiated deflate command (block 610). FIG. 34 is a generalization of the block diagram of FIG. 29.

For occupant supports having three or more bladders per side it is thought to be desirable to concurrently inflate all the bladders on a given side at block 602 in order to avoid twisting the occupant or subjecting the occupant to other adverse effects that might arise from inflating fewer than all the bladders.

Figure 35:
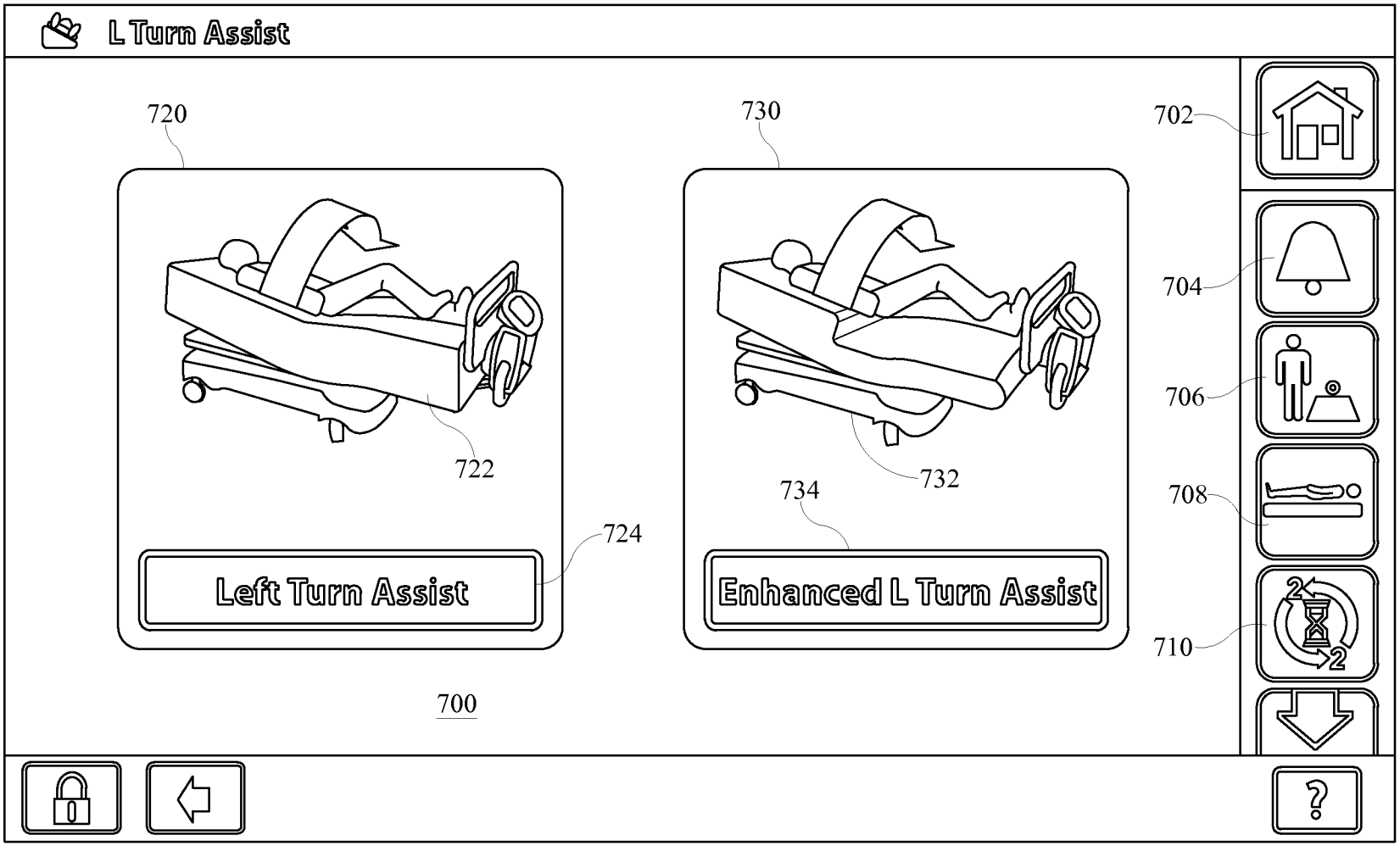
FIGS. 35-38 are illustrations related to graphical user interfaces/touch screen interfaces.
Figure 36:
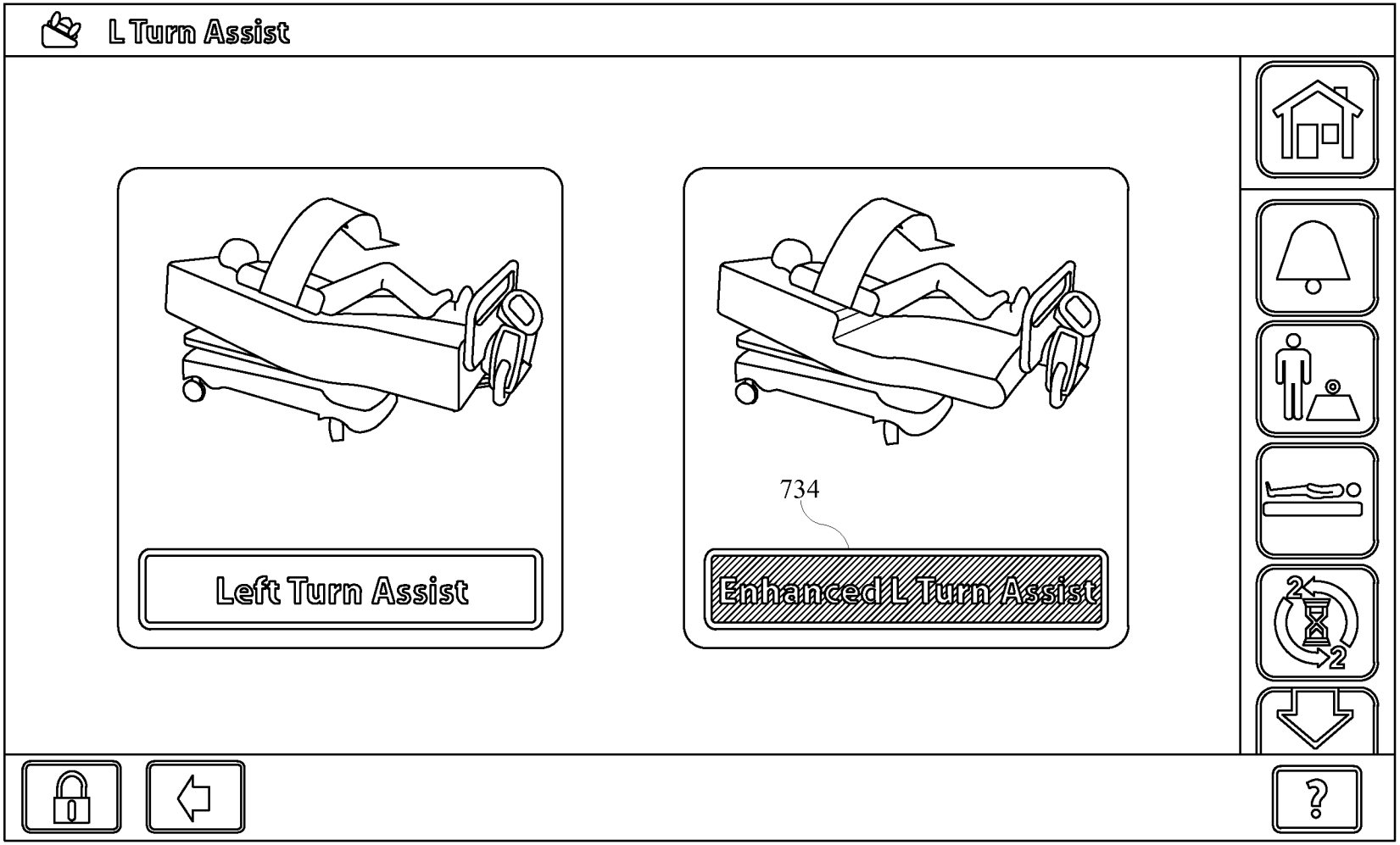
Figure 37:
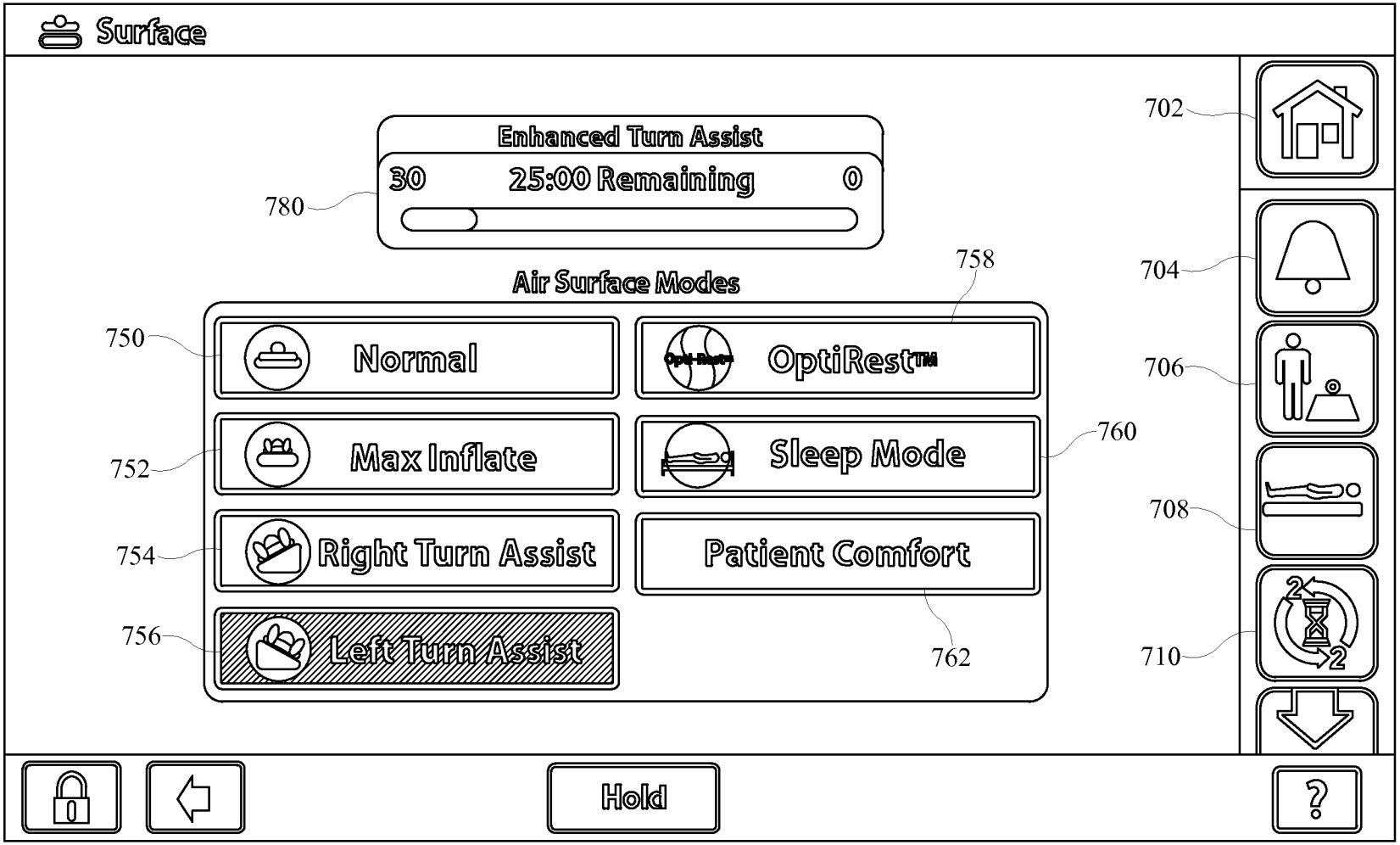
Figure 38:
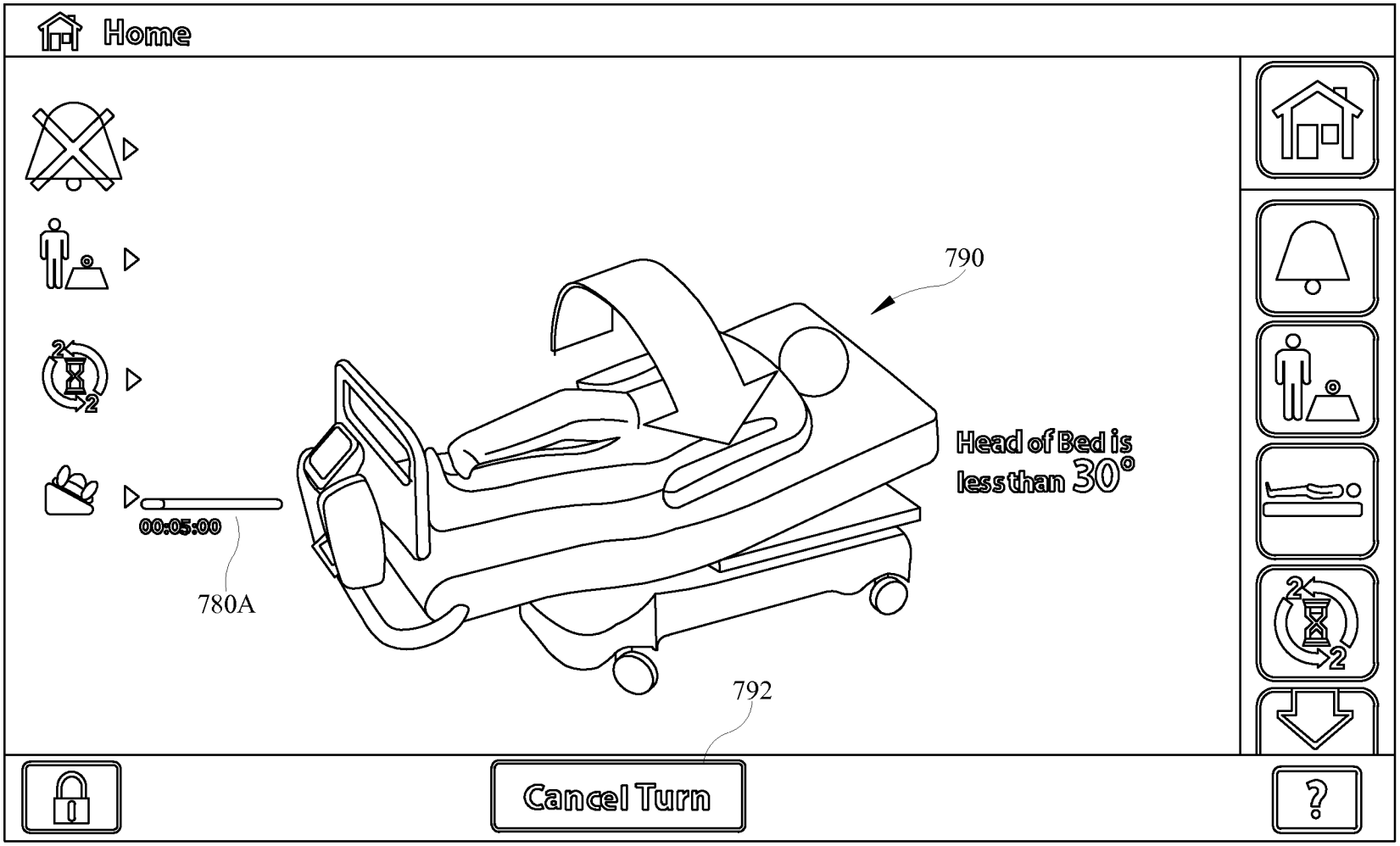

FIGS. 35-38 are related to graphical user interfaces/touch screen interfaces. FIG. 35 shows an interface display 700 with five touch sensitive icons 702, 704, 706, 708, 710 stacked vertically along the right side of the display. The center of the display is occupied by a pair of images. Left image 720 shows a graphic 722 of a bed occupant being turned to his left and includes a touch sensitive icon 724 labeled "Left Turn Assist". Right image 730 shows a graphic 732 of a bed occupant being turned to his left and includes a touch sensitive icon 734 labeled "Enhanced L Turn Assist". Graphic 722 and icon 724 are related to conventional turn assist operation. Graphic 732 and icon 734 are related to the enhanced turn assist operation described in the instant application for providing improved access to a target region of the occupant. FIG. 36 is the same as FIG. 35 but shows icon 734 in an illuminated state to reveal that a user has selected the enhanced mode of operation. Similar displays are used for right turn assist and enhanced right turn assist. FIG. 37 shows a display with icons 702 through 701 stacked along the right side of the display, but also shows seven touch sensitive icons 750, 752, 754, 756, 758, 760, 762, which allow a user to select among seven functions, two of which are right and left turn assist (icons 754, 756). Icon 756 is in an illuminated state to reveal that a turn assist function has been selected (which selection would have activated the display of FIG. 35). The display also includes a time meter 780 to indicate temporal progress. FIG. 38 is a display with a graphic 790 similar to graphic 732 of FIG. 35 but more magnified and from a different perspective. FIG. 38 also includes a time meter 780A similar to time meter 780 of FIG. 37 and also accompanied by text to indicate that the enhanced left turn assist mode has been selected. A touch sensitive "CANCEL" icon 792 is provided to allow a user to cancel operation.

Description of a Third Variant

Figure 39:
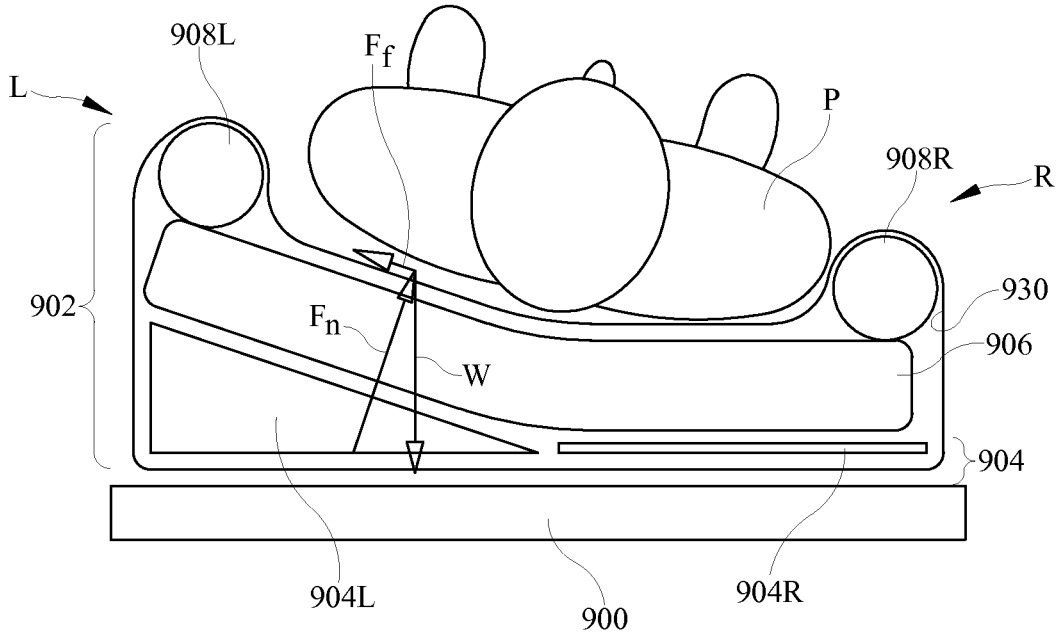
FIG. 39 is a schematic head end elevation view of a mattress having a turn layer with left and right turn effectors and also having a support layer with side bolsters.
Figure 40:
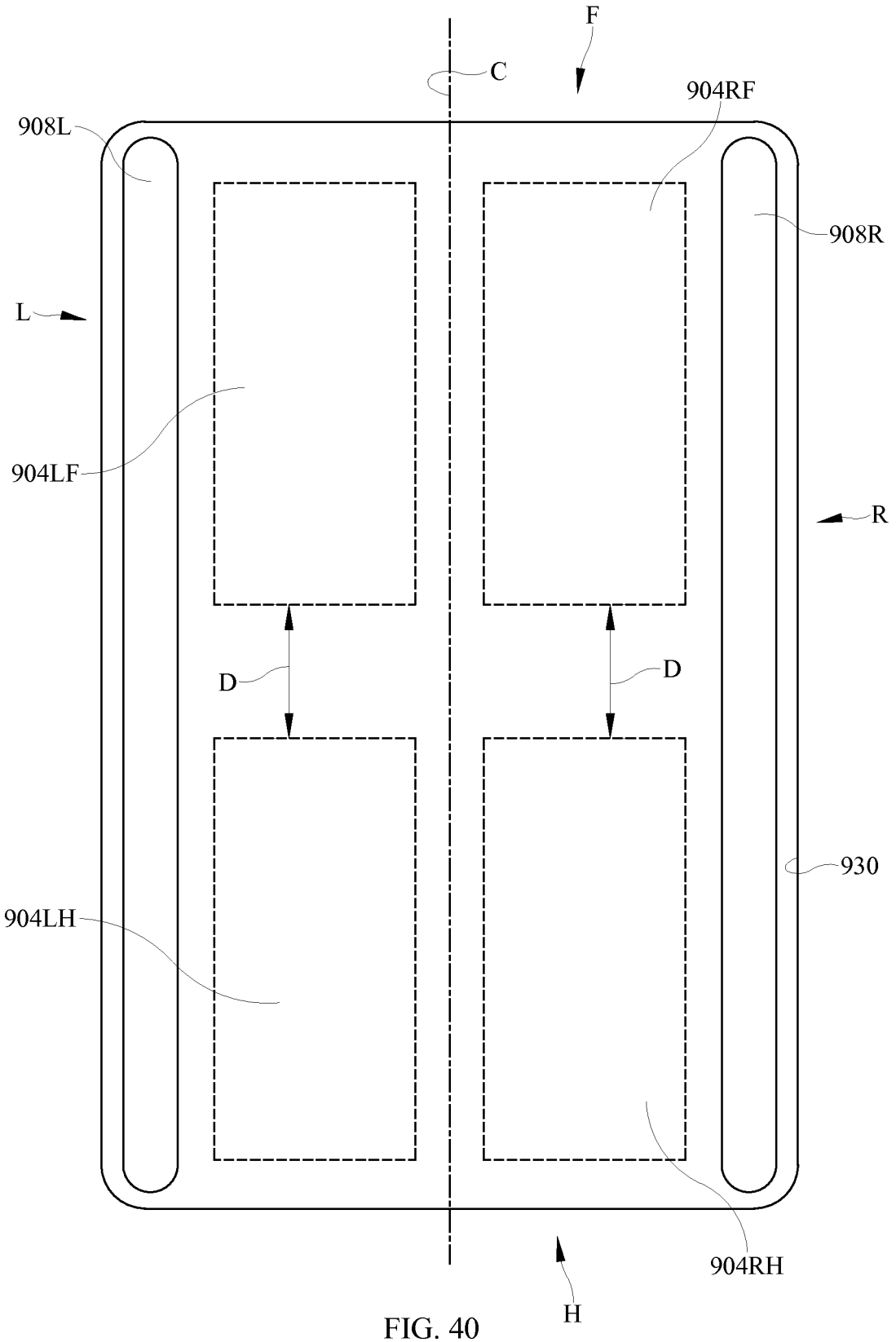
FIG. 40 is a plan view of one variant of the mattress of FIG. 39 in which the left turn effector and the right turn effector each comprise two longitudinally distributed turn effectors.
Figure 41:
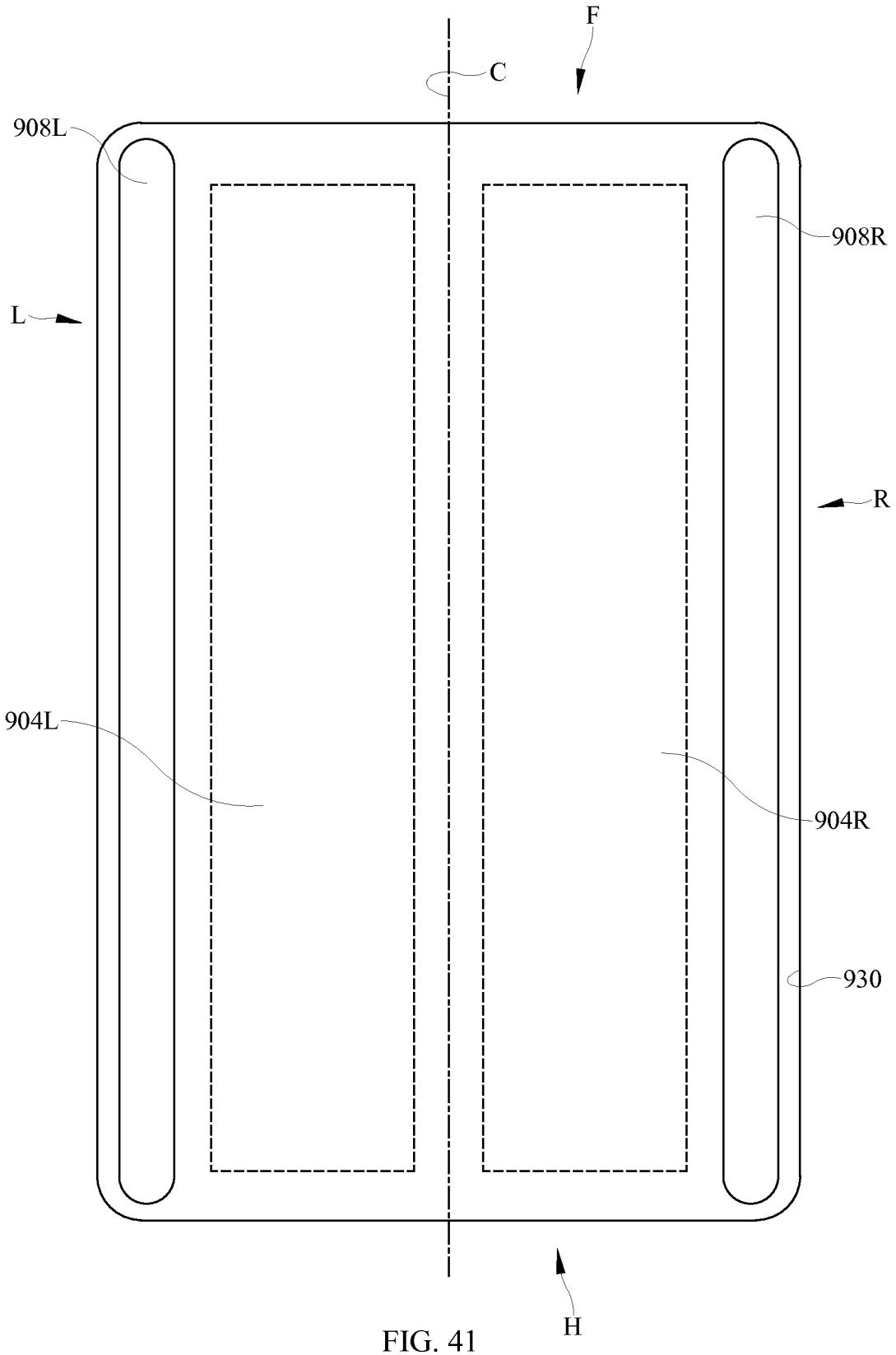
FIG. 41 is a plan view of another variant of the mattress of FIG. 39 in which the left turn effector and the right turn effector are each a single turn effector.

Referring to FIGS. 39, 40 and 41 a hospital bed includes a deck 900, which may be considered to be a component of a bed frame, not shown, and a mattress 902. The mattress includes a turn layer 904 comprising left and right turn effectors 904L, 904R. The mattress also includes a support layer 906 atop the turn effectors. The support layer extends laterally from a left side L to a right side R and longitudinally from a head end H to a foot end F. In the illustrated mattress the support layer and the turn effectors are bladders which can be appropriately pressurized, e.g. with air, to provide satisfactory occupant support and to laterally rotate the occupant (laterally rotating an occupant means turning the occupant to his right or left). In FIG. 39 bladder 904L is shown in an inflated state while bladder 904R is shown in a deflated state. As a result supine occupant or patient P is rotated to his right (his left side is more elevated than his right side). The mattress also includes left and right longitudinally extending bolsters 908L, 908R bordering the left and right sides of the support layer. A ticking or covering 930 extends around the turn layer, the support layer and the bolsters.

In the variant of the mattress seen in FIG. 41 the left effector or bladder and the right effector or bladder are each a single bladder. In the different variant seen in FIG. 40 the left effector is a set of two longitudinally distributed left side bladders 904LH, 904LF that are longitudinally spaced from each other by an interbladder distance D. Bladder 904LH is referred to as a head end bladder due to its location closer to the head end of the bed and bladder 904LF is referred to as a foot end bladder due to its location closer to the foot end of the bed. Similarly the right effector is a set of two longitudinally distributed right side bladders 904RH, 904RF that are longitudinally spaced from each other by interbladder distance D. Bladder 904RH is referred to as a head end bladder due to its location closer to the head end of the bed and bladder 904RF is referred to as a foot end bladder due to its location closer to the foot end of the bed. More than two bladders may be used on each side of the bed if desired.

It can be desirable to periodically turn a bed occupant laterally (from left to right) in order to temporarily reduce or remove supporting loads that would otherwise act on the occupant for unsuitably long intervals of time with the attendant risk that the occupant could develop pressure ulcers. A typical turn protocol is to turn the occupant in one direction (e.g. to his left) and maintain him in that turned orientation for no more than a prescribed interval of time, then to turn him back to a flat orientation for no more than the prescribed time interval, then to turn him in the opposite direction (e.g. to his right) for no more than the prescribed interval of time, then to turn him back again to the flat orientation. The cycle is repeated as long as necessary and is carried out manually or semimanually (i.e. a caregiver uses turn bladders for assistance in turning the occupant, but must visit the bedside to operate the bladders at the expiration of each time interval. When an occupant is laterally turned his position on the mattress is maintained by friction acting in a direction shown by frictional force arrow $F_f$ in FIG. 39 (the vector diagram shows resolution of the occupant's weight W into a component $F_n$ normal to the inclined left side portion of the mattress and component $F_f$ parallel to the inclined left side portion of the mattress). As a result the occupant's skin and soft tissue are subject to shear forces which could lead to skin breakdown. However due to bolsters 908 the side of the occupant which is at a lower elevation can rest against and be supported by the bolster. The frictional force required to maintain the occupant on the inclined mattress portion is therefore reduced by the supporting force provided by the bolster. Accordingly, shear on the occupant is reduced. Thus, a method of relieving loading on an occupant of a bed includes the steps of turning the occupant laterally in a first turn direction (e.g. to his left) and maintaining the occupant in an orientation resulting from the turning in the first turn direction for a predefined first interval of time while supporting the occupant in a first support direction consistent with reducing the frictional force that would otherwise act on the occupant.

After expiration of the first time interval the method may simply return the occupant to a flat orientation and, after maintaining the occupant at that orientation for an interval of time, turn him again in the first direction as described above and repeat the turn/maintain/return cycle as often as desired. This is referred to as unilateral operation. However bilateral operation, in which the occupant is turned alternately to the left and right, is likely to be more useful in most cases. Thus, the method includes, after expiration of the first interval, turning the occupant laterally in a second turn direction (e.g. to his right) and maintaining the occupant in the orientation resulting from the turning in the second turn direction for a predefined second interval of time while supporting the occupant in a second support direction consistent with reducing the frictional force that would otherwise act on the occupant. Both unilateral and bilateral operation can proceed for a single cycle or for multiple cycles. Although FIG. 39 shows inflatable/deflatable bolsters, both of which are inflated, only one bolster needs to be inflated, i.e. only right bolster 908R needs to be inflated for a right turn and only left bolster 908L needs to be inflated for a left turn.

Either unilateral or bilateral operation may also include maintaining the occupant in a non-turned orientation for a third interval of time after expiration of the first interval of time and before turning the occupant in the second turn direction.

In another variant the method includes reducing or relaxing interface pressure (pressure acting normal to the occupant) along at least a portion of the length of the occupant. One portion of the patient in which it is desirable to effect such reduction in interface pressure is the occupant's sacrum. One way to reduce interface pressure is to reduce pressure in support bladder 906, a turn bladder 904 or both in a zone corresponding to the occupant's sacrum or other portion of the patient where interface pressure reduction is desired.

Another method of relieving loading on an occupant of a bed comprises turning the occupant laterally in a first turn direction (e.g. to his left) and maintaining the occupant in an orientation resulting from the turning in the first turn direction for a predefined first interval of time and relaxing interface pressure along at least a portion of the length of the occupant during at least part of the first interval. As with the method previously described the relaxed interface pressure may be achieved by reducing pressure in a support bladder, a turn bladder or both in a zone corresponding to the occupant's sacrum or other portion of the patient where interface pressure reduction is desired.

After expiration of the first time interval the method may simply return the occupant to a flat orientation and, after maintaining the occupant at that orientation for an interval of time, turn him again in the first direction as just described and repeat the turn/maintain/return cycle as often as desired. This is referred to as unilateral operation. However bilateral operation, in which the occupant is turned alternately to the left and right, is likely to be more useful in most cases. Thus, the method includes, after expiration of the first interval, turning the occupant laterally in a second turn direction (e.g. to his right) and maintaining the occupant in the orientation resulting from the turning in the second turn direction for a predefined second interval of time and relaxing interface pressure along at least a portion of the length of the occupant during at least part of the second interval. Both unilateral and bilateral operation can proceed for a single cycle or for multiple cycles.

Either unilateral or bilateral operation may also include maintaining the occupant in a non-turned orientation for a third interval of time after expiration of the first interval of time and before turning the occupant in the second turn direction. The method may also include maintaining the relaxed interface pressure during at least a portion of the third interval.

Figure 42:
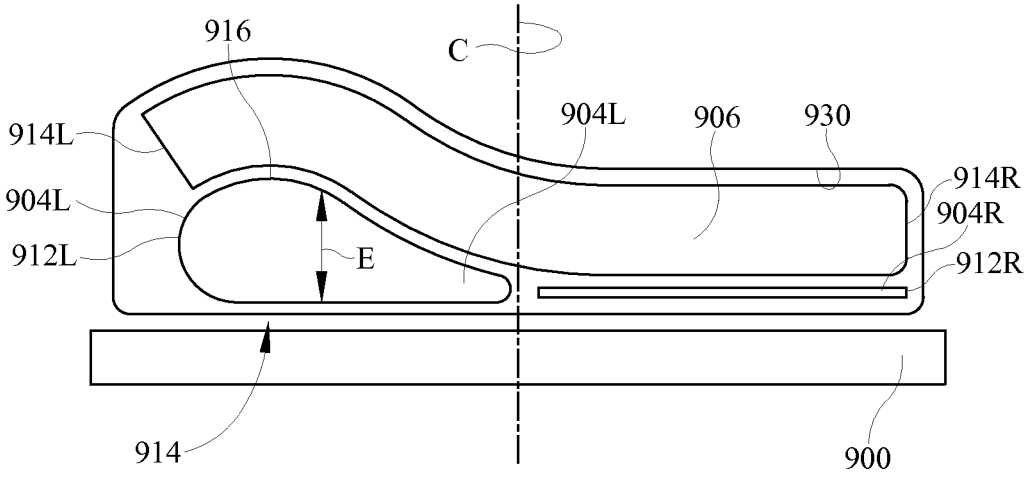
FIG. 42 is a head end elevation view of a mattress having a turn layer with left and right turn effectors and also having a support layer.

FIG. 42 shows a mattress comprising left and right turn effectors or bladders 904L, 904R and a support layer 906 atop the turn bladders. The turn layer extends laterally from a left edge 912L to a right edge 912R which may or may not coincide with left and right edges 914L, 914R of the support layer. When one of the turn bladders is inflated (904L in the illustration) the result can be suboptimum in that the elevation E of the turn bladder does not necessarily increase along the entire lateral distance from centerplane C to lateral edge 912L. Instead, as shown in the illustration, elevation E increases from the centerplane to lateral location 916 inboard of the edge and decreases in elevation from location 916 to edge 912L resulting in a hump having a peak at location 916 laterally between the centerplane and the edge and substantially offset from the edge.

Figure 43:
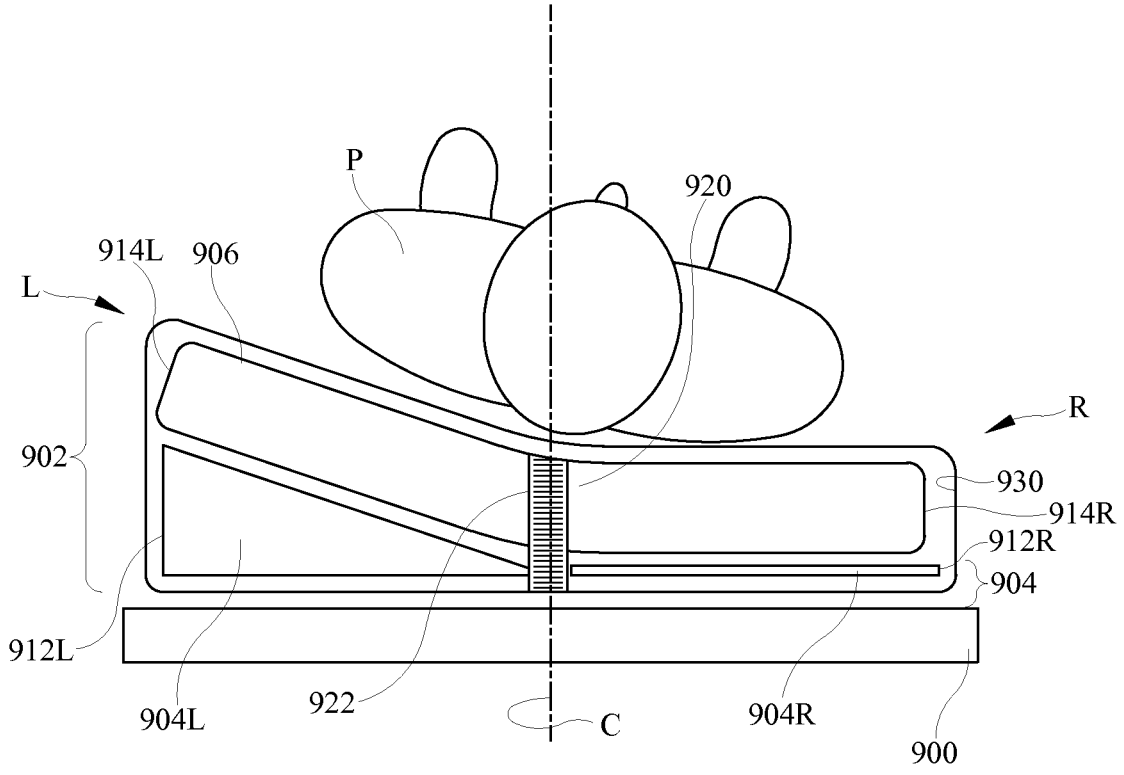
FIG. 43 is a head end elevation view of a mattress similar to that of FIG. 42 but having a centertie in the form of a strap.

FIG. 43 shows a mattress 902 designed to address the above problem. The mattress comprises a turn layer 904 having left and right turn effectors 904L, 904R and a support layer 906 atop the turn effectors. The turn layer extends laterally from a turn layer left edge 912L to a turn layer right edge 912R which may or may not coincide with left and right edges 914L, 914R of the support layer. The support layer extends laterally from a support layer left edge 914L to a support layer right edge 914R. The mattress also includes a center tie 920 positioned intermediate the edges, e.g. at centerplane C. The center tie is so named because mattresses are typically symmetrical about a longitudinally extending centerplane and therefore the center tie would typically coincide with that plane. Nevertheless the actual location of the center tie is not restricted to be at the lateral center of the mattress. The centertie anchors support layer 906 to covering 930 thereby applying a counterforce to the support layer laterally between the left and right turn effectors. By doing so the center tie spatially constrains the turn bladders when they are inflated. As a result, the cross section of the inflated bladder is more like a ramp (FIG. 43) than a hump (FIG. 42).

Figure 44:
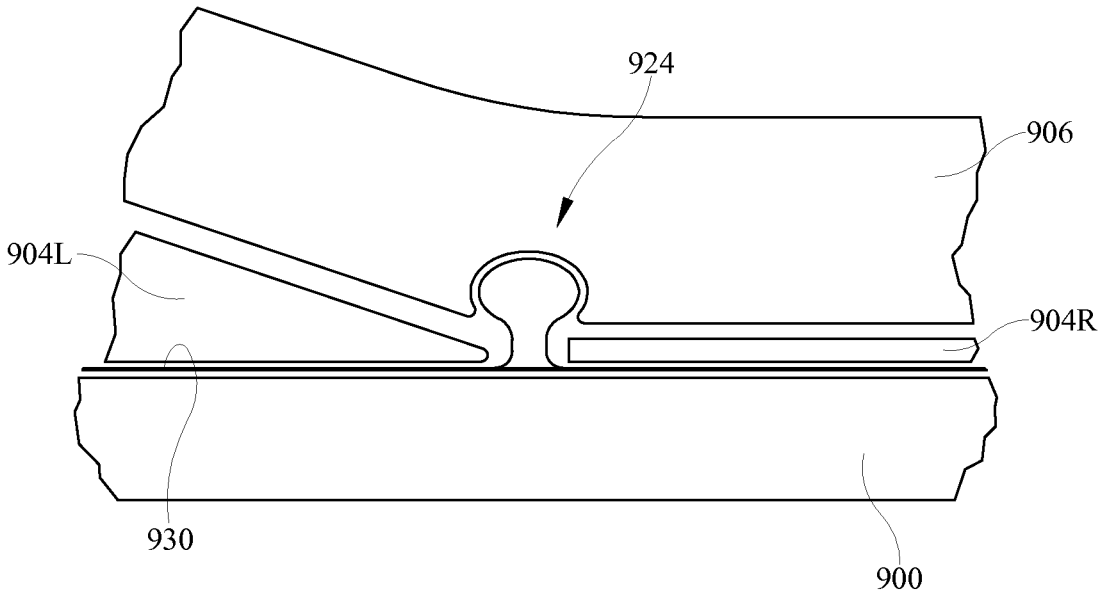
FIG. 44 is a head end elevation view of a mattress similar to that of FIG. 43 but having a centertie in the form of a snap joint.
Figure 45:
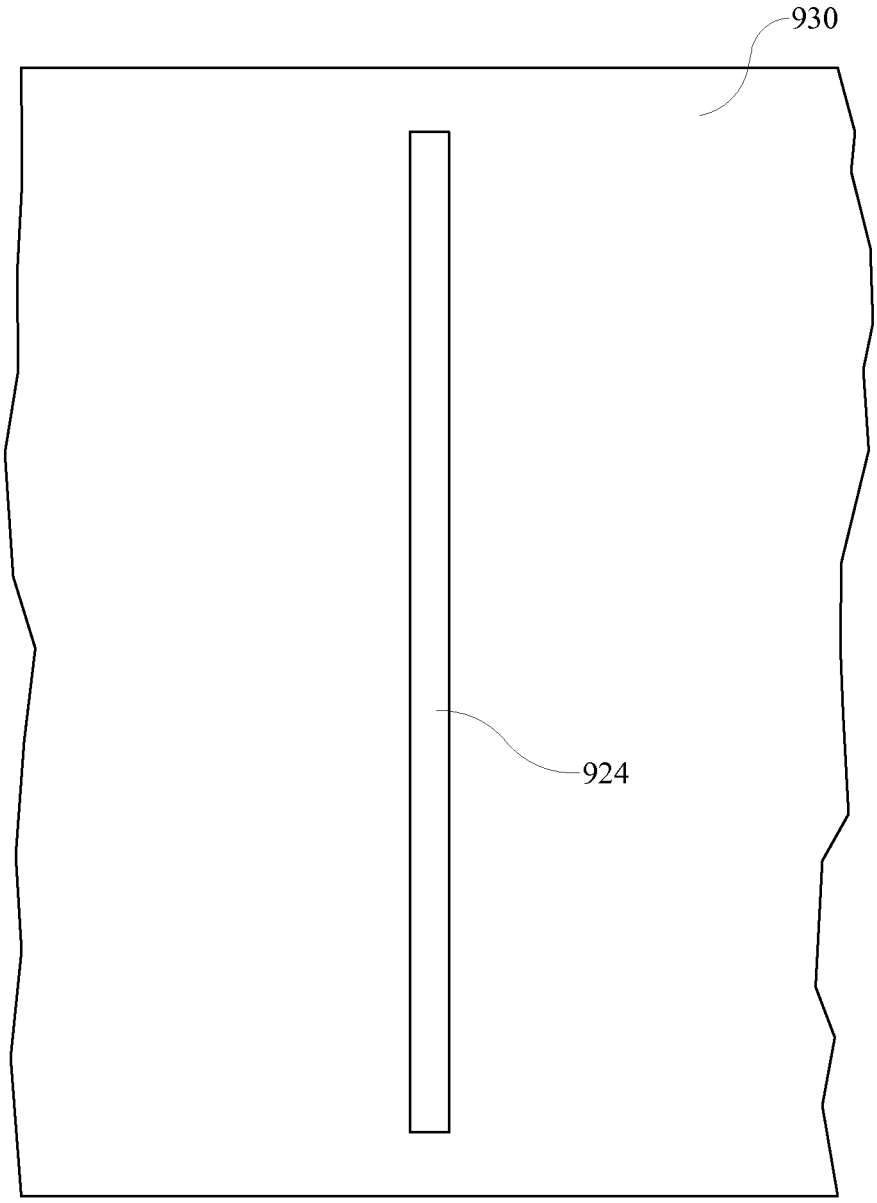
FIGS. 45 and 46 are plan views of a deck which underlies the mattress of FIG. 44 showing a continuous variant and a discrete variant respectively of the snap joint.
Figure 46:
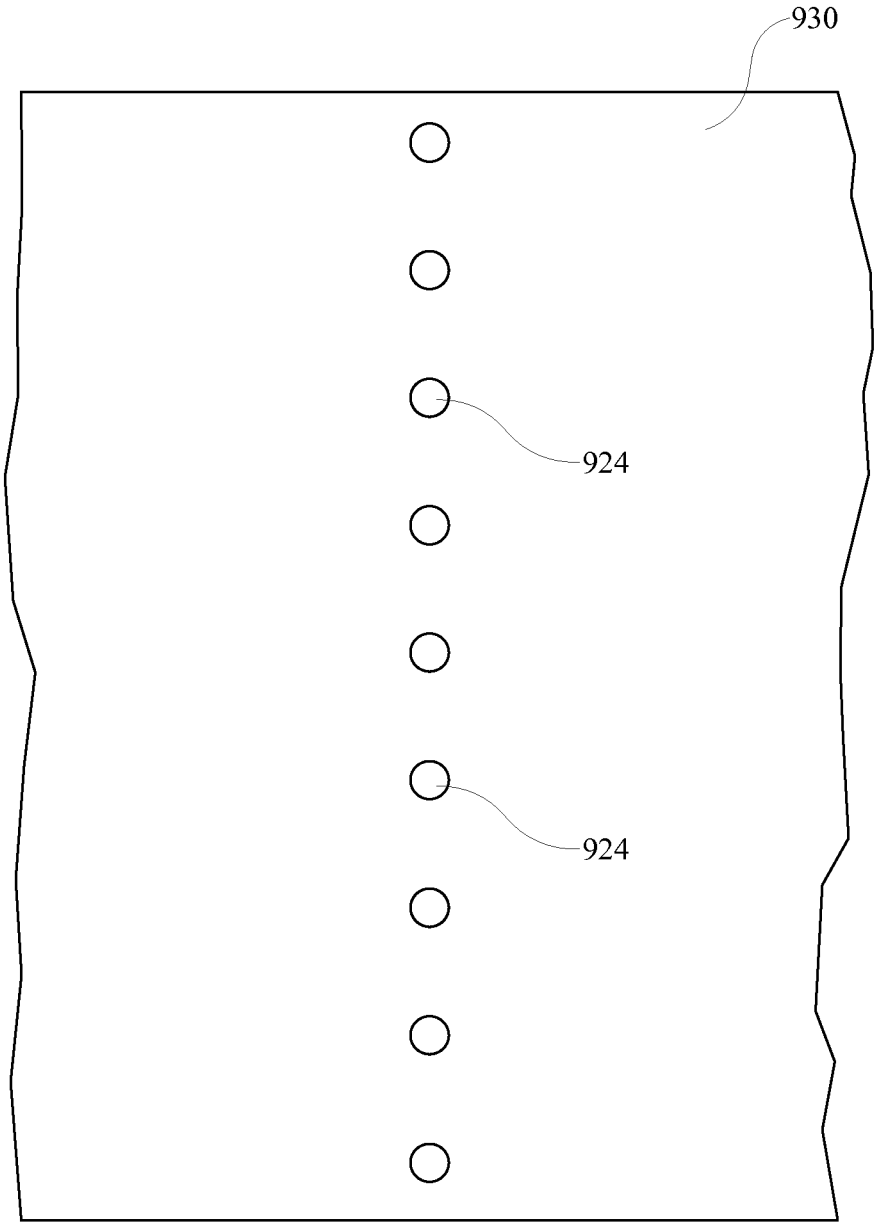
Figure 47:
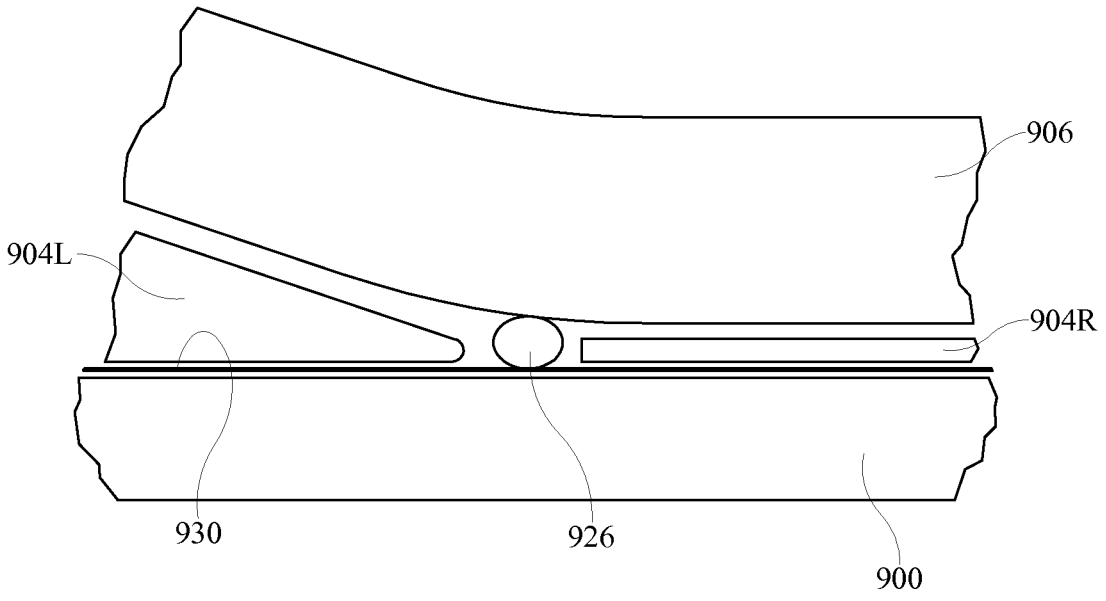
FIG. 47 is a head end elevation view of a mattress similar to that of FIG. 43 but having a centertie in the form of a weld.
Figure 48:
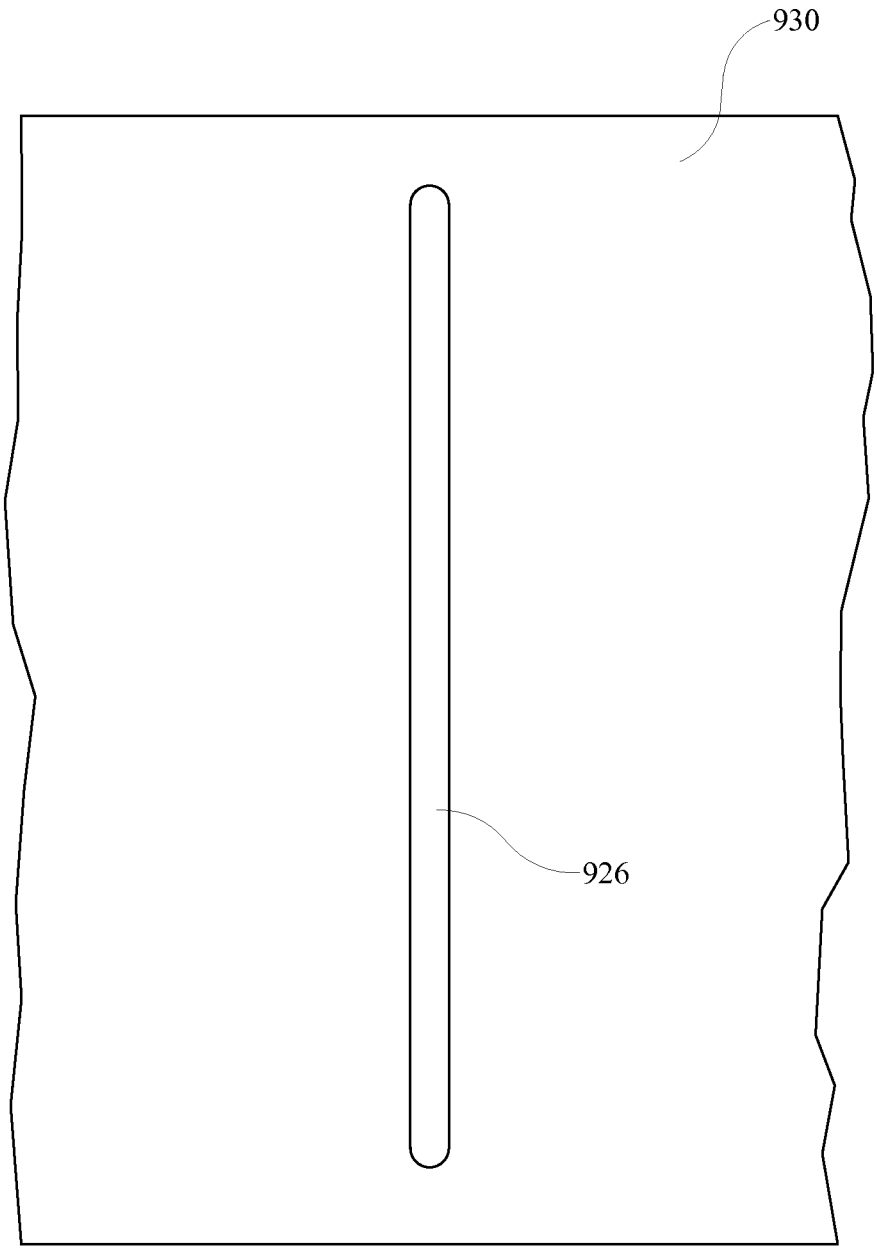
FIGS. 48 and 49 are plan views of a deck which underlies the mattress of FIG. 47 showing a continuous variant and a discrete variant respectively of the weld.
Figure 49:
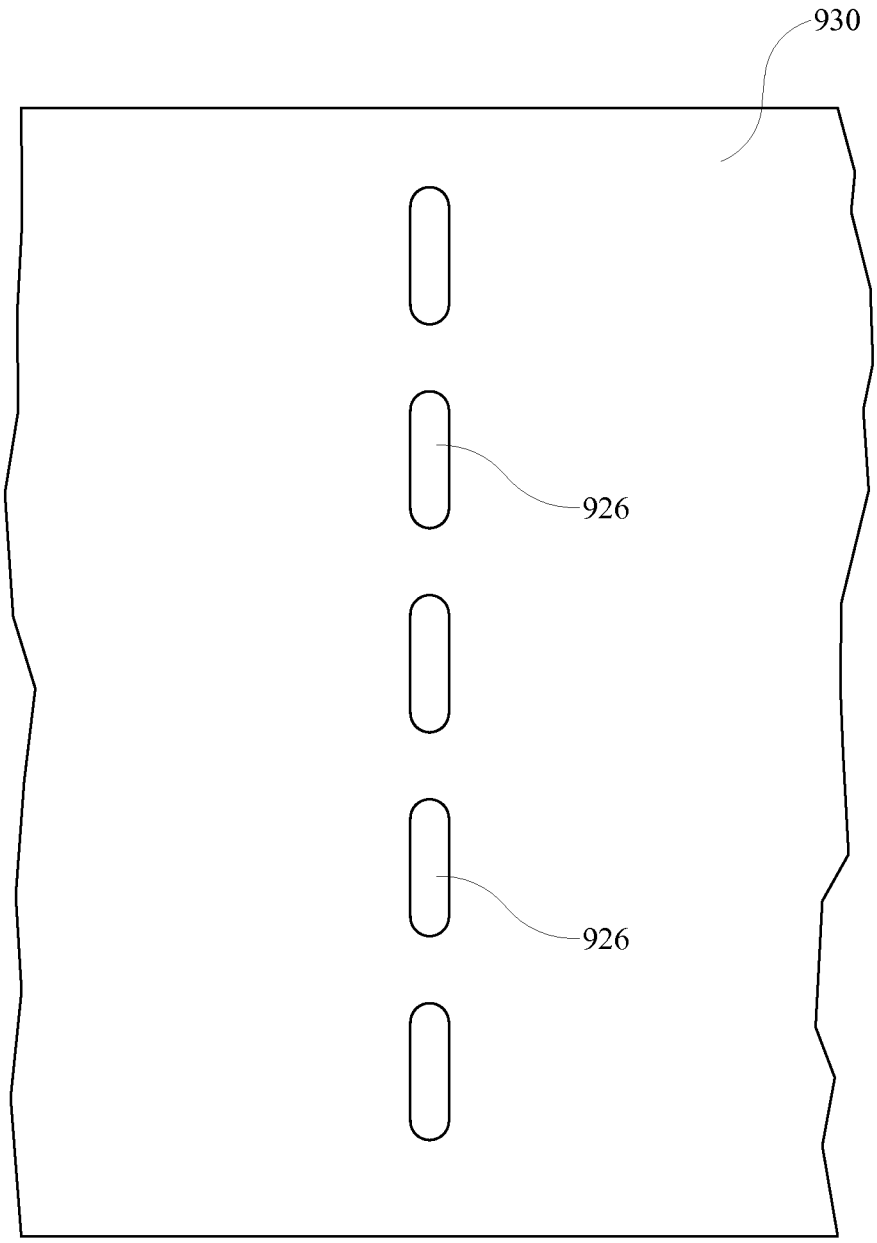

In the variant of FIG. 43 the center tie is a strap 922. In the variant of FIGS. 44 through 46 the center tie is a longitudinally extending snap joint 924 which may be longitudinally continuous (FIG. 45) or may be comprised of discrete snap elements (FIG. 46) (FIGS. 45 and 46 show only the side of the snap joint associated with covering 930, not the mating side associated with support layer 906. In the variant of FIG. 47 through 49 the center tie is a longitudinally extending weld 926 which may be longitudinally continuous (FIG. 48) or may be comprised of discrete spot welds (FIG. 49) (FIGS. 48 and 49 show the weld along covering 930, not along support layer 906).

Although center tie 920 (e.g strap 922, snap joint 924, weld 926) has been shown and described as anchoring support layer 906 to covering 930, another variant, not shown, employs the center tie to anchor the support layer to deck 900.

We claim:

1. An occupant support comprising:

a turn assist layer which includes:

a left side array of two or more longitudinally distributed turn assist members, each member of the array comprising one or more longitudinally distributed turn assist bladders, at least two of the array members being longitudinally spaced from each other by a left intermember reach-in space having a left intermember dimension;

a right side array of two or more longitudinally distributed turn assist members, each member of the array comprising one or more longitudinally distributed turn assist bladders, at least two of the array members being longitudinally spaced from each other by a right intermember reach-in space having a right intermember dimension;

a support layer above the turn assist layer, the support layer including a collapsible zone at least part of which overlies the intermember spaces; and a user interface for enabling a user to operate the turn assist layer; and a controller for inflating and deflating the collapsible zone in coordination with inflation and deflation of at least one of the turn assist members defining the intermember space which the collapsible zone overlies.

2. The occupant support of claim 1 wherein the left side array and the right side array are substantially mirror images of each other.

3. The occupant support of claim 1 in which the left side array comprises exactly two members and the right side array comprises exactly two members.

4. The occupant support of claim 3 wherein each member is a single bladder.

5. The occupant support of claim 3 wherein the left intermember dimension and the right intermember dimension are each about 20 centimeters (8 inches).

6. The occupant support of claim 1 wherein the left and right intermember spaces are substantially longitudinally aligned with each other.

7. The occupant support of claim 1 wherein the collapsible zone comprises one or more longitudinally distributed bladders.

8. The occupant support of claim 1 wherein the intermember dimension defines a reach-in space that extends longitudinally from a more footward location corresponding substantially to the gluteal sulcus of a nominally positioned occupant to a more headward location corresponding approximately to the sacral base of the nominally positioned occupant.

9. The occupant support of claim 8 wherein the more footward location and the more headward location are longitudinally separated from each other by at least about 20 centimeters (8 inches).

10. The occupant support of claim 1 wherein each bladder comprises a casing which bounds a volume of space and wherein the contents of the space consist essentially of a bladder pressurizing medium.

11. The occupant support of claim 1 wherein the controller is adapted to inflate a selected one of the arrays of turn assist members in response to a first user command and to maintain inflation of the selected array until receipt of a second user command.

12. The occupant support of claim 11 wherein the controller is also adapted to deflate the collapsible zone of the support layer and to maintain deflation of the collapsible zone until receipt of the second user command.

13. The occupant support of claim 1 wherein the inflation and deflation of the collapsible zone is carried out concurrently, partially concurrently, or serially with the inflation and deflation of the turn assist member or members.

14. The occupant support of claim 12 wherein the controller is adapted to deflate the collapsible zone concurrently, partially concurrently, or serially with the inflation and deflation of the turn assist member or members.

15. The occupant support of claim 12 wherein the controller is also adapted to overinflate at least part of the support layer other than the collapsible zone thereof.

16. An occupant support comprising:

a turn assist layer which includes:

a left side array of two or more longitudinally distributed turn assist members, each member of the array comprising one or more longitudinally distributed turn assist bladders, at least two of the array members being longitudinally spaced from each other by a left intermember reach-in space having a left intermember dimension;

a right side array of two or more longitudinally distributed turn assist members, each member of the array comprising one or more longitudinally distributed turn assist bladders, at least two of the array members being longitudinally spaced from each other by a right intermember reach-in space having a right intermember dimension;

a support layer above the turn assist layer, the support layer including a collapsible zone at least part of which overlies the intermember spaces; and a user interface for enabling a user to operate the turn assist layer;

wherein each intermember dimension defines a reach-in space that extends longitudinally from a more footward location corresponding substantially to the gluteal sulcus of a nominally positioned occupant to a more headward location corresponding approximately to the sacral base of the nominally positioned occupant.

* * * * *